US008656550B2

(12) United States Patent
Jones et al.

(10) Patent No.: US 8,656,550 B2
(45) **Date of Patent: *Feb. 25, 2014**

(54) AUTONOMOUS FLOOR-CLEANING ROBOT

(75) Inventors: Joseph L. Jones, Acton, MA (US); Newton E. Mack, Somerville, MA (US); David M. Nugent, Newport, RI (US); Paul E. Sandin, Randolph, MA (US)

(73) Assignee: iRobot Corporation, Bedford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/824,785

(22) Filed: Jun. 28, 2010

(65) Prior Publication Data

US 2010/0263158 A1 Oct. 21, 2010

Related U.S. Application Data

(60) Continuation of application No. 12/201,554, filed on Aug. 29, 2008, which is a division of application No. 10/818,073, filed on Apr. 5, 2004, now Pat. No. 7,571,511, which is a continuation of application No. 10/320,729, filed on Dec. 16, 2002, now Pat. No. 6,883,201.

(60) Provisional application No. 60/345,764, filed on Jan. 3, 2002.

(51) Int. Cl.
*A47L 5/00* (2006.01)

(52) U.S. Cl.
USPC ..... 15/319; 15/340.1; 15/360

(58) Field of Classification Search
USPC ..... 15/319, 339, 52.1, 340.1, 356, 360, 15/340.3; 700/245
See application file for complete search history.

(56) References Cited

U.S. PATENT DOCUMENTS 1,755,054 A 4/1930 Darst
1,780,221 A * 11/1930 Buchmann ..... 15/194

(Continued)

FOREIGN PATENT DOCUMENTS

DE 3536907 A1 4/1986
DE 9311014 U1 10/1993

(Continued)

OTHER PUBLICATIONS

Morland, "Autonomous Lawnmower Control," Downloaded from the internet at: http://cns.bu.edu/~cjmorlan/robotics/lawnmower/report.pdf, 10 pages, Jul. 24, 2002.

(Continued)

*Primary Examiner* — Robert Scruggs
(74) *Attorney, Agent, or Firm* — Fish & Richardson P.C.

(57) ABSTRACT

A floor-cleaning robot includes a wheeled housing having a perimeter, a motor drive operably connected to wheels of the housing to move the robot across a floor surface, and a bumper responsive to obstacles encountered by the robot. A controller is in electrical communication with both the bumper and the motor drive and is configured to control the motor drive to maneuver the robot to avoid detected obstacles across the floor surface during a floor-cleaning operation. A driven cleaning brush, rotatable about an axis substantially parallel to an underside of the housing, is disposed substantially across a central region of the underside and is positioned to brush the floor surface as the robot is moved across the floor surface. Additionally, a driven side brush extending beyond the perimeter is positioned to brush floor surface debris from beyond the perimeter toward a projected path of the driven cleaning brush.

43 Claims, 13 Drawing Sheets

(56) References Cited

U.S. PATENT DOCUMENTS 1,970,302 A 8/1934 Gerhardt
2,136,324 A 11/1938 Louis
2,302,111 A 11/1942 Dow et al.
2,770,825 A 11/1956 Pullen
3,457,575 A 7/1969 Bienek
3,550,714 A 12/1970 Bellinger
3,674,316 A 7/1972 De Bray
RE28,268 E 12/1974 Autrand
3,863,285 A 2/1975 Hukuba
3,937,174 A 2/1976 Haaga
4,004,313 A 1/1977 Capra
4,099,284 A 7/1978 Shinozaki et al.
4,119,900 A 10/1978 Kremnitz
4,175,892 A 11/1979 De brey
4,196,727 A 4/1980 Verkaart et al.
4,198,727 A 4/1980 Farmer
4,306,329 A 12/1981 Yokoi
4,309,758 A 1/1982 Halsall et al.
4,328,545 A 5/1982 Halsall et al.
4,369,543 A 1/1983 Chen et al.
4,445,245 A 5/1984 Lu
4,465,370 A 8/1984 Yuasa et al.
4,482,960 A 11/1984 Pryor
4,513,469 A 4/1985 Godfrey et al.
4,556,313 A 12/1985 Miller, Jr. et al.
4,624,026 A 11/1986 Olson et al.
4,626,995 A 12/1986 Lofgren et al.
4,662,854 A 5/1987 Fang
4,674,048 A 6/1987 Okumura
4,679,152 A 7/1987 Perdue
4,696,074 A 9/1987 Cavalli
4,700,301 A 10/1987 Dyke
4,700,427 A 10/1987 Knepper
4,716,621 A 1/1988 Zoni
4,733,430 A 3/1988 Westergren
4,733,431 A 3/1988 Martin
4,756,049 A 7/1988 Uehara
4,777,416 A 10/1988 George, II et al.
4,782,550 A 11/1988 Jacobs
4,811,228 A 3/1989 Hyyppa
4,815,157 A 3/1989 Tsuchiya
4,851,661 A 7/1989 Everett, Jr.
4,854,000 A 8/1989 Takimoto
4,854,006 A 8/1989 Nishimura et al.
4,857,912 A 8/1989 Everett, Jr. et al.
4,887,415 A 12/1989 Martin
4,893,025 A 1/1990 Lee
4,901,394 A 2/1990 Nakamura et al.
4,912,643 A 3/1990 Beirxe
4,918,441 A 4/1990 Bohman
4,919,224 A 4/1990 Shyu et al.
4,920,605 A 5/1990 Takashima
4,933,864 A 6/1990 Evans, Jr. et al.
4,956,891 A 9/1990 Wulff
4,962,453 A 10/1990 Pong et al.
4,967,862 A 11/1990 Pong et al.
4,974,283 A 12/1990 Holsten et al.
5,002,145 A 3/1991 Waqkaumi et al.
5,018,240 A 5/1991 Holman
5,020,186 A 6/1991 Lessig, III et al.
5,032,775 A 7/1991 Mizuno et al.
5,070,567 A * 12/1991 Holland ..... 15/28
5,084,934 A 2/1992 Lessig, III et al.
5,086,535 A 2/1992 Grossmeyer et al.
5,093,955 A 3/1992 Blehert et al.
5,105,502 A 4/1992 Takashima
5,109,566 A 5/1992 Kobayashi et al.
5,115,538 A 5/1992 Cochran et al.
5,127,128 A 7/1992 Lee
5,136,750 A 8/1992 Takashima et al.
5,142,985 A 9/1992 Stearns et al.
5,144,715 A 9/1992 Matsuyo et al.
5,152,028 A 10/1992 Hirano
5,163,202 A 11/1992 Kawakami et al.
5,165,064 A 11/1992 Mattaboni
5,182,833 A 2/1993 Yamaguchi et al.
5,204,814 A 4/1993 Noonan et al.
5,208,521 A 5/1993 Aoyama
5,216,777 A 6/1993 Moro et al.
5,233,682 A 8/1993 Abe et al.
5,239,720 A 8/1993 Wood et al.
5,251,358 A 10/1993 Moro et al.
5,261,139 A 11/1993 Lewis
5,276,618 A 1/1994 Everett, Jr.
5,279,672 A 1/1994 Betker et al.
5,284,522 A 2/1994 Kobayashi et al.
5,293,955 A 3/1994 Lee
5,303,448 A 4/1994 Hennessey et al.
5,307,273 A 4/1994 Oh et al.
5,309,592 A 5/1994 Hiratsuka
5,319,828 A 6/1994 Waldhauser et al.
5,321,614 A 6/1994 Ashworth
5,324,948 A 6/1994 Dudar et al.
5,341,540 A 8/1994 Soupert et al.
5,345,649 A 9/1994 Whitlow
5,353,224 A 10/1994 Lee et al.
5,369,347 A 11/1994 Yoo
5,386,862 A 2/1995 Glover et al.
5,400,244 A 3/1995 Watanabe et al.
5,410,479 A 4/1995 Coker
5,440,216 A 8/1995 Kim
5,444,965 A 8/1995 Colens
5,446,356 A 8/1995 Kim
5,446,445 A 8/1995 Bloomfield et al.
5,454,129 A 10/1995 Kell
5,455,982 A 10/1995 Armstrong et al.
5,465,525 A 11/1995 Mifune et al.
5,467,273 A 11/1995 Faibish et al.
5,497,529 A 3/1996 Boesi
5,507,067 A 4/1996 Hoekstra et al.
5,515,572 A 5/1996 Hoekstra et al.
5,534,762 A 7/1996 Kim
5,537,017 A 7/1996 Feiten et al.
5,539,953 A 7/1996 Kurz
5,542,146 A 8/1996 Hoekstra et al.
5,542,148 A 8/1996 Young
5,548,511 A 8/1996 Bancroft
5,553,349 A 9/1996 Kilstrom et al.
5,555,587 A 9/1996 Guha
5,560,077 A 10/1996 Crotchett
5,568,589 A 10/1996 Hwang
5,608,944 A 3/1997 Gordon
5,611,106 A 3/1997 Wulff
5,611,108 A 3/1997 Knowlton et al.
5,613,261 A 3/1997 Kawakami et al.
5,621,291 A 4/1997 Lee
5,622,236 A 4/1997 Azumi et al.
5,634,237 A 6/1997 Paranjpe
5,634,239 A 6/1997 Tuvin et al.
5,636,402 A 6/1997 Kubo et al.
5,650,702 A 7/1997 Azumi
5,652,489 A 7/1997 Kawakami
5,682,313 A 10/1997 Edlund et al.
5,682,839 A 11/1997 Grimsley et al.
5,696,675 A 12/1997 Nakamura et al.
5,709,007 A 1/1998 Chiang
5,714,119 A 2/1998 Kawagoe et al.
5,717,484 A 2/1998 Hamaguchi et al.
5,720,077 A 2/1998 Nakamura et al.
5,732,401 A 3/1998 Conway
5,735,959 A 4/1998 Kubo et al.
5,761,762 A 6/1998 Kubo
5,781,960 A 7/1998 Kilstrom et al.
5,787,545 A 8/1998 Colens
5,793,900 A 8/1998 Nourbakhsh et al.
5,794,297 A 8/1998 Muta
5,812,267 A 9/1998 Everett, Jr. et al.
5,815,880 A 10/1998 Nakanishi
5,819,008 A 10/1998 Asama et al.
5,819,360 A 10/1998 Fujii
5,820,821 A 10/1998 Kawagoe et al.
5,825,981 A 10/1998 Matsuda
5,839,156 A 11/1998 Park et al.
5,841,259 A 11/1998 Kim et al.

(56) References Cited

U.S. PATENT DOCUMENTS 5,867,800 A 2/1999 Leif
5,869,910 A 2/1999 Colens
5,894,621 A 4/1999 Kubo
5,896,611 A * 4/1999 Haaga ..... 15/42
5,903,124 A 5/1999 Kawakami
5,911,260 A * 6/1999 Suzuki ..... 15/401
5,926,909 A 7/1999 McGee
5,935,179 A 8/1999 Kleiner et al.
5,940,927 A 8/1999 Haegermarck et al.
5,940,930 A 8/1999 Oh et al.
5,942,869 A 8/1999 Katou et al.
5,943,730 A 8/1999 Boomgaarden
5,943,733 A 8/1999 Tagliaferri
5,947,225 A 9/1999 Kawakami et al.
5,959,423 A 9/1999 Nakanishi et al.
5,974,348 A 10/1999 Rocks
5,987,383 A 11/1999 Keller et al.
5,991,951 A 11/1999 Kubo et al.
5,995,883 A 11/1999 Nishikado
5,995,884 A 11/1999 Allen et al.
5,996,167 A * 12/1999 Close ..... 15/230.12
5,998,953 A 12/1999 Nakamura et al.
6,021,545 A 2/2000 Delgado et al.
6,023,814 A 2/2000 Imamura
6,025,687 A 2/2000 Himeda et al.
6,030,464 A * 2/2000 Azevedo ..... 134/6
6,030,465 A 2/2000 Marcussen et al.
6,038,501 A 3/2000 Kawakami
6,041,471 A 3/2000 Charky et al.
6,052,821 A 4/2000 Chouly et al.
6,070,290 A 6/2000 Schwarze et al.
6,076,025 A 6/2000 Ueno et al.
6,076,226 A 6/2000 Reed
6,101,670 A 8/2000 Song
6,108,076 A 8/2000 Hanseder
6,112,143 A 8/2000 Allen et al.
6,112,996 A 9/2000 Matsuo
6,119,057 A 9/2000 Kawagoe
6,122,798 A 9/2000 Kobayashi et al.
6,124,694 A 9/2000 Bancroft et al.
6,138,063 A 10/2000 Himeda
6,142,252 A 11/2000 Kinto et al.
6,160,479 A 12/2000 Ahlen et al.
6,226,830 B1 * 5/2001 Hendriks et al. ..... 15/319
6,240,342 B1 5/2001 Fiegert et al.
6,255,793 B1 7/2001 Peless et al.
6,259,979 B1 7/2001 Holmquist
6,261,379 B1 7/2001 Conrad et al.
6,276,478 B1 8/2001 Hopkins et al.
6,285,930 B1 9/2001 Dickson et al.
6,286,181 B1 * 9/2001 Kasper et al. ..... 15/320
6,300,737 B1 10/2001 Bergvall et al.
6,321,515 B1 11/2001 Colens
6,327,741 B1 12/2001 Reed
6,339,735 B1 1/2002 Peless et al.
6,370,453 B2 4/2002 Sommer
6,374,155 B1 4/2002 Wallach et al.
6,374,157 B1 4/2002 Takamura
6,381,802 B2 5/2002 Park
6,385,515 B1 5/2002 Dickson et al.
6,389,329 B1 5/2002 Colens
6,408,226 B1 6/2002 Byrne et al.
6,412,141 B2 7/2002 Kasper et al.
6,421,870 B1 7/2002 Basham et al.
6,430,471 B1 8/2002 Kintou et al.
6,438,456 B1 8/2002 Feddema et al.
6,442,476 B1 8/2002 Poropat
6,443,509 B1 9/2002 Levin et al.
6,444,003 B1 9/2002 Sutcliffe
6,457,206 B1 10/2002 Judson
6,459,955 B1 * 10/2002 Bartsch et al. ..... 700/245
6,463,368 B1 10/2002 Feiten et al.
6,465,982 B1 10/2002 Bergvall et al.
6,481,515 B1 11/2002 Kirkpatrick et al.
6,482,252 B1 11/2002 Conrad et al.
6,493,612 B1 * 12/2002 Bisset et al. ..... 701/23
6,493,613 B2 12/2002 Peless et al.
6,496,754 B2 12/2002 Song et al.
6,496,755 B2 12/2002 Wallach et al.
6,507,773 B2 1/2003 Parker et al.
6,525,509 B1 2/2003 Petersson et al.
6,530,102 B1 3/2003 Pierce et al.
6,532,404 B2 3/2003 Colens
6,535,793 B2 3/2003 Allard
6,540,607 B2 4/2003 Mokris et al.
6,548,982 B1 4/2003 Papanikolopoulos et al.
6,571,415 B2 6/2003 Gerber et al.
6,574,536 B1 6/2003 Kawagoe et al.
6,580,246 B2 6/2003 Jacobs
6,581,239 B1 6/2003 Dyson et al.
6,584,376 B1 6/2003 Van Kommer
6,586,908 B2 7/2003 Petersson et al.
6,590,222 B1 7/2003 Bisset et al.
6,594,551 B2 7/2003 McKinney, Jr.
6,594,844 B2 7/2003 Jones
6,601,265 B1 8/2003 Burlington
6,604,022 B2 8/2003 Parker et al.
6,605,156 B1 8/2003 Clark et al.
6,611,120 B2 8/2003 Song et al.
6,611,734 B2 8/2003 Parker et al.
6,611,738 B2 8/2003 Ruffner
6,615,108 B1 9/2003 Peless et al.
6,625,843 B2 9/2003 Kim et al.
6,629,028 B2 9/2003 Paromtchik et al.
6,633,150 B1 10/2003 Wallach et al.
6,637,546 B1 10/2003 Wang
6,658,693 B1 12/2003 Reed, Jr.
6,661,239 B1 12/2003 Ozick
6,662,889 B2 12/2003 De Fazio et al.
6,671,592 B1 12/2003 Bisset et al.
6,690,134 B1 2/2004 Jones et al.
6,732,826 B2 5/2004 Song et al.
6,741,054 B2 * 5/2004 Koselka et al. ..... 318/445
6,741,364 B2 5/2004 Lange et al.
6,748,297 B2 6/2004 Song et al.
6,764,373 B1 7/2004 Osawa et al.
6,774,596 B1 8/2004 Bisset
6,781,338 B2 8/2004 Jones et al.
6,809,490 B2 10/2004 Jones et al.
6,830,120 B1 12/2004 Yashima et al.
6,832,407 B2 12/2004 Salem et al.
6,841,963 B2 1/2005 Song et al.
6,845,297 B2 1/2005 Allard
6,859,010 B2 2/2005 Jeon et al.
6,865,447 B2 3/2005 Lau et al.
6,870,792 B2 3/2005 Chiappetta
6,883,201 B2 4/2005 Jones et al.
6,901,624 B2 6/2005 Mori et al.
6,925,357 B2 8/2005 Wang et al.
6,925,679 B2 8/2005 Wallach et al.
6,929,548 B2 8/2005 Wang
D510,066 S 9/2005 Hickey et al.
6,938,298 B2 9/2005 Aasen
6,940,291 B1 9/2005 Ozick
6,956,348 B2 10/2005 Landry et al.
6,957,712 B2 10/2005 Song et al.
6,965,209 B2 11/2005 Jones et al.
6,968,592 B2 11/2005 Takeuchi et al.
6,971,140 B2 12/2005 Kim
6,999,850 B2 2/2006 McDonald
7,013,527 B2 3/2006 Thomas, Sr. et al.
7,024,278 B2 4/2006 Chiappetta et al.
7,024,280 B2 4/2006 Parker et al.
7,031,805 B2 4/2006 Lee et al.
7,053,578 B2 5/2006 Diehl et al.
7,055,210 B2 6/2006 Keppler et al.
7,059,012 B2 6/2006 Song et al.
7,069,124 B1 6/2006 Whittaker et al.
7,079,923 B2 7/2006 Abramson et al.
7,085,624 B2 8/2006 Aldred et al.
7,113,847 B2 9/2006 Chmura et al.
7,133,746 B2 11/2006 Abramson et al.
7,155,308 B2 12/2006 Jones
7,167,775 B2 1/2007 Abramson et al.

(56) References Cited

U.S. PATENT DOCUMENTS 7,171,285 B2 1/2007 Kim et al.
7,173,391 B2 2/2007 Jones et al.
7,188,000 B2 3/2007 Chiappetta et al.
7,201,786 B2 4/2007 Wegelin et al.
7,206,677 B2 4/2007 Hulden
7,225,500 B2 6/2007 Diehl et al.
7,246,405 B2 7/2007 Yan
7,248,951 B2 7/2007 Hulden
7,288,912 B2 10/2007 Landry et al.
7,318,248 B1 1/2008 Yan
7,320,149 B1 1/2008 Huffman et al.
7,324,870 B2 1/2008 Lee
7,332,890 B2 2/2008 Cohen et al.
7,346,428 B1 3/2008 Huffman et al.
7,352,153 B2 4/2008 Yan
7,359,766 B2 4/2008 Jeon et al.
7,360,277 B2 4/2008 Moshenrose et al.
7,389,156 B2 6/2008 Ziegler et al.
7,389,166 B2 6/2008 Harwig et al.
7,408,157 B2 8/2008 Yan
7,418,762 B2 9/2008 Arai et al.
7,430,455 B2 9/2008 Casey et al.
7,444,206 B2 10/2008 Abramson et al.
7,448,113 B2 11/2008 Jones et al.
7,459,871 B2 12/2008 Landry et al.
7,474,941 B2 1/2009 Kim et al.
7,503,096 B2 3/2009 Lin
7,515,991 B2 4/2009 Egawa et al.
7,555,363 B2 6/2009 Augenbraun et al.
7,568,259 B2 8/2009 Yan
7,571,511 B2 8/2009 Jones et al.
7,578,020 B2 8/2009 Jaworski et al.
7,600,521 B2 10/2009 Woo
7,603,744 B2 10/2009 Reindle
7,617,557 B2 11/2009 Reindle
7,636,982 B2 12/2009 Jones et al.
7,647,144 B2 1/2010 Haegermarck
7,650,666 B2 1/2010 Jang
7,660,650 B2 2/2010 Kawagoe et al.
7,663,333 B2 2/2010 Jones et al.
7,693,605 B2 4/2010 Park
7,706,917 B1 4/2010 Chiappetta et al.
7,720,554 B2 5/2010 DiBernardo et al.
7,801,645 B2 9/2010 Taylor et al.
7,805,220 B2 9/2010 Taylor et al.
7,849,555 B2 12/2010 Hahm et al.
7,920,941 B2 4/2011 Park et al.
7,937,800 B2 5/2011 Yan
7,957,836 B2 6/2011 Myeong et al.
2001/0047231 A1 11/2001 Peless et al.
2001/0047895 A1 12/2001 De Fazio et al.
2002/0011813 A1 1/2002 Koselka et al.
2002/0016649 A1 2/2002 Jones
2002/0112742 A1 8/2002 Bredo et al.
2002/0120364 A1 8/2002 Colens
2002/0124343 A1 9/2002 Reed
2002/0156556 A1 10/2002 Ruffner
2002/0166193 A1 11/2002 Kasper
2002/0173877 A1 11/2002 Zweig
2003/0019071 A1 1/2003 Field et al.
2003/0023356 A1 1/2003 Keable
2003/0025472 A1 2/2003 Jones et al.
2003/0030399 A1 2/2003 Jacobs
2003/0060928 A1 3/2003 Abramson et al.
2003/0120389 A1 6/2003 Abramson et al.
2003/0137268 A1 7/2003 Papanikolopoulos et al.
2003/0192144 A1 10/2003 Song et al.
2003/0216834 A1 11/2003 Allard
2003/0229421 A1 12/2003 Chmura et al.
2003/0229474 A1 12/2003 Suzuki et al.
2003/0233177 A1 12/2003 Johnson et al.
2004/0020000 A1 2/2004 Jones
2004/0030448 A1 2/2004 Solomon
2004/0030449 A1 2/2004 Solomon
2004/0030450 A1 2/2004 Solomon
2004/0030571 A1 2/2004 Solomon
2004/0031113 A1 2/2004 Wosewick et al.
2004/0049877 A1 3/2004 Jones et al.
2004/0055163 A1 3/2004 McCambridge et al.
2004/0068351 A1 4/2004 Solomon
2004/0068415 A1 4/2004 Solomon
2004/0068416 A1 4/2004 Solomon
2004/0074044 A1 4/2004 Diehl et al.
2004/0076324 A1 4/2004 Burl et al.
2004/0083570 A1 5/2004 Song et al.
2004/0085037 A1 5/2004 Jones et al.
2004/0088079 A1 5/2004 Lavarec et al.
2004/0111184 A1 6/2004 Chiappetta et al.
2004/0111273 A1 6/2004 Sakagami et al.
2004/0113777 A1 6/2004 Matsuhira et al.
2004/0134336 A1 7/2004 Solomon
2004/0134337 A1 7/2004 Solomon
2004/0143919 A1 7/2004 Wilder
2004/0156541 A1 8/2004 Jeon et al.
2004/0158357 A1 8/2004 Lee et al.
2004/0187249 A1 9/2004 Jones et al.
2004/0187457 A1 9/2004 Colens
2004/0200505 A1 10/2004 Taylor et al.
2004/0204792 A1 10/2004 Taylor et al.
2004/0210347 A1 10/2004 Sawada et al.
2004/0211444 A1 10/2004 Taylor et al.
2004/0236468 A1 11/2004 Taylor et al.
2004/0244138 A1 12/2004 Taylor et al.
2004/0255425 A1 12/2004 Arai et al.
2005/0000543 A1 1/2005 Taylor et al.
2005/0010331 A1 1/2005 Taylor et al.
2005/0028316 A1 2/2005 Thomas et al.
2005/0137749 A1 6/2005 Jeon et al.
2005/0144751 A1 7/2005 Kegg
2005/0150074 A1 7/2005 Diehl et al.
2005/0150519 A1 7/2005 Keppler et al.
2005/0156562 A1 7/2005 Cohen et al.
2005/0166355 A1 8/2005 Tani
2005/0172445 A1 8/2005 Diehl et al.
2005/0183229 A1 8/2005 Uehigashi
2005/0183230 A1 8/2005 Uehigashi
2005/0187678 A1 8/2005 Myeong et al.
2005/0192707 A1 9/2005 Park et al.
2005/0204717 A1 9/2005 Colens
2005/0209736 A1 9/2005 Kawagoe
2005/0213082 A1 9/2005 DiBernardo et al.
2005/0217042 A1 10/2005 Reindle
2005/0218852 A1 10/2005 Landry et al.
2005/0229340 A1 10/2005 Sawalski et al.
2005/0229355 A1 10/2005 Crouch et al.
2005/0235451 A1 10/2005 Yan
2005/0273967 A1 12/2005 Taylor et al.
2005/0288819 A1 12/2005 de Guzman
2006/0000050 A1 1/2006 Cipolla et al.
2006/0020369 A1 1/2006 Taylor et al.
2006/0020370 A1 1/2006 Abramson
2006/0021168 A1 2/2006 Nishikawa
2006/0037170 A1 2/2006 Shimizu
2006/0042042 A1 3/2006 Mertes et al.
2006/0061657 A1 3/2006 Rew et al.
2006/0100741 A1 5/2006 Jung
2006/0119839 A1 6/2006 Bertin et al.
2006/0143295 A1 6/2006 Costa-Requena et al.
2006/0150361 A1 7/2006 Aldred et al.
2006/0196003 A1 9/2006 Song et al.
2006/0259194 A1 11/2006 Chiu
2006/0288519 A1 12/2006 Jaworski et al.
2007/0006404 A1 1/2007 Cheng et al.
2007/0017061 A1 1/2007 Yan
2007/0028574 A1 2/2007 Yan
2007/0032904 A1 2/2007 Kawagoe et al.
2007/0042716 A1 2/2007 Goodall et al.
2007/0043459 A1 2/2007 Abbott, III et al.
2007/0061041 A1 3/2007 Zweig
2007/0114975 A1 5/2007 Cohen et al.
2007/0142964 A1 6/2007 Abramson
2007/0150096 A1 6/2007 Yeh et al.
2007/0157415 A1 7/2007 Lee et al.
2007/0157420 A1 7/2007 Lee et al.

(56) References Cited

U.S. PATENT DOCUMENTS

| | | | |
|---|---|---|---|
| 2007/0213892 | A1 | 9/2007 | Jones et al. |
| 2007/0226949 | A1 | 10/2007 | Hahm et al. |
| 2007/0234492 | A1 | 10/2007 | Svendsen et al. |
| 2007/0266508 | A1 | 11/2007 | Jones et al. |
| 2008/0000042 | A1 | 1/2008 | Jones et al. |
| 2008/0007203 | A1 | 1/2008 | Cohen et al. |
| 2008/0015738 | A1 | 1/2008 | Casey et al. |
| 2008/0052846 | A1 | 3/2008 | Kapoor et al. |
| 2008/0091304 | A1 | 4/2008 | Ozick et al. |
| 2008/0184518 | A1 | 8/2008 | Taylor |
| 2008/0281470 | A1 | 11/2008 | Gilbert, Jr. et al. |
| 2008/0302586 | A1 | 12/2008 | Yan |
| 2008/0307590 | A1 | 12/2008 | Jones et al. |
| 2009/0038089 | A1 | 2/2009 | Landry et al. |
| 2009/0049640 | A1 | 2/2009 | Lee et al. |
| 2009/0055022 | A1 | 2/2009 | Casey et al. |
| 2009/0279222 | A1 | 11/2009 | Keller |
| 2009/0292393 | A1 | 11/2009 | Casey et al. |
| 2010/0011529 | A1 | 1/2010 | Won et al. |
| 2010/0049365 | A1 | 2/2010 | Jones et al. |
| 2010/0063628 | A1 | 3/2010 | Landry et al. |
| 2010/0107355 | A1 | 5/2010 | Won et al. |
| 2010/0257690 | A1 | 10/2010 | Jones et al. |
| 2010/0257691 | A1 | 10/2010 | Jones et al. |
| 2010/0263158 | A1 | 10/2010 | Jones et al. |
| 2010/0268384 | A1 | 10/2010 | Jones et al. |
| 2010/0312429 | A1 | 12/2010 | Jones et al. |
| 2011/0131741 | A1 | 6/2011 | Jones et al. |

FOREIGN PATENT DOCUMENTS

| | | | |
|---|---|---|---|
| DE | 4338841 | A1 | 5/1995 |
| DE | 4414683 | A1 | 10/1995 |
| DE | 198 49 978 | | 5/2000 |
| DE | 19849978 | | 2/2001 |
| DE | 10242257 | | 4/2003 |
| DE | 102004038074 | | 6/2005 |
| DE | 10357636 | | 7/2005 |
| DE | 102004041021 | | 8/2005 |
| DE | 102004041021 | B3 | 8/2005 |
| DE | 102005046813 | | 4/2007 |
| DE | 102005046813 | A1 | 4/2007 |
| DK | 338988 | A | 12/1988 |
| EP | 265542 | A1 | 5/1988 |
| EP | 281085 | A2 | 9/1988 |
| EP | 286328 | A1 | 10/1988 |
| EP | 294101 | A2 | 12/1988 |
| EP | 307381 | A2 | 3/1989 |
| EP | 352045 | A2 | 1/1990 |
| EP | 358628 | A2 | 3/1990 |
| EP | 389459 | A2 | 9/1990 |
| EP | 433697 | A2 | 6/1991 |
| EP | 479273 | A2 | 4/1992 |
| EP | 554978 | A2 | 8/1993 |
| EP | 615719 | A1 | 9/1994 |
| EP | 0 792 726 | | 9/1997 |
| EP | 845237 | A1 | 6/1998 |
| EP | 1018315 | A1 | 7/2000 |
| EP | 0835459 | | 9/2001 |
| EP | 1172719 | A1 | 1/2002 |
| EP | 1228734 | | 8/2002 |
| EP | 1149333 | | 11/2002 |
| EP | 1 331 537 | A1 | 7/2003 |
| EP | 1139847 | | 8/2003 |
| EP | 1 380 245 | | 1/2004 |
| EP | 1380246 | | 1/2004 |
| EP | 1 557 730 | | 7/2005 |
| EP | 1 331 537 | B1 | 8/2005 |
| EP | 1642522 | | 4/2006 |
| EP | 1672455 | | 6/2006 |
| ES | 2238196AA | | 8/2005 |
| FR | 722755 | A | 3/1932 |
| FR | 2601443 | A1 | 1/1988 |
| FR | 2 828 589 | | 2/2003 |
| GB | 702426 | | 1/1954 |
| GB | 2213047 | | 8/1989 |
| GB | 2213047 | A | 8/1989 |
| GB | 2225221 | | 5/1990 |
| GB | 2267360 | A | 12/1993 |
| GB | 2 283 838 | | 5/1995 |
| GB | 2284957 | A | 6/1995 |
| GB | 2300082 | A | 10/1996 |
| GB | 2344747 | A | 6/2000 |
| GB | 2409966 | | 7/2005 |
| JP | 53-021869 | | 2/1978 |
| JP | 53110257 | A2 | 9/1978 |
| JP | 57-014726 | | 1/1982 |
| JP | 57014726 | A2 | 1/1982 |
| JP | 57064217 | A2 | 4/1982 |
| JP | 59033511 | A2 | 2/1984 |
| JP | 59-33511 | | 3/1984 |
| JP | 59033511 | U | 3/1984 |
| JP | 59094005 | A2 | 5/1984 |
| JP | 59099308 | A2 | 6/1984 |
| JP | 59112311 | A2 | 6/1984 |
| JP | 59131668 | A2 | 7/1984 |
| JP | 59164973 | A2 | 9/1984 |
| JP | 59184917 | A2 | 10/1984 |
| JP | 2283343 | A2 | 11/1984 |
| JP | 59212924 | A2 | 12/1984 |
| JP | 59226909 | A2 | 12/1984 |
| JP | 60089213 | | 5/1985 |
| JP | 60089213 | A2 | 5/1985 |
| JP | 60211510 | A2 | 10/1985 |
| JP | 60-259895 | | 11/1985 |
| JP | 60-293095 | | 12/1985 |
| JP | 61023221 | A2 | 1/1986 |
| JP | 61097712 | U | 6/1986 |
| JP | 61160366 | A2 | 7/1986 |
| JP | 62070709 | U | 5/1987 |
| JP | 62-120510 | | 6/1987 |
| JP | 62-154008 | | 7/1987 |
| JP | 62-164431 | | 7/1987 |
| JP | 62189057 | A2 | 8/1987 |
| JP | 62263507 | A2 | 11/1987 |
| JP | 62-292126 | | 12/1987 |
| JP | 62292126 | A2 | 12/1987 |
| JP | 63-183032 | | 7/1988 |
| JP | 63203483 | A2 | 8/1988 |
| JP | 63-241610 | | 10/1988 |
| JP | 62074018 | | 10/1988 |
| JP | 1162454 | A2 | 6/1989 |
| JP | 02-006312 | | 1/1990 |
| JP | 2006312 | U1 | 1/1990 |
| JP | 02-283343 | | 11/1990 |
| JP | 03-051023 | | 3/1991 |
| JP | 3-51023 | A | 3/1991 |
| JP | 3051023 | A2 | 3/1991 |
| JP | 3197758 | A2 | 8/1991 |
| JP | 3201903 | A2 | 9/1991 |
| JP | 4019586 | A2 | 1/1992 |
| JP | 4074285 | A2 | 3/1992 |
| JP | 4084921 | A2 | 3/1992 |
| JP | 05-046246 | | 2/1993 |
| JP | 5023269 | A2 | 2/1993 |
| JP | 5040519 | A2 | 2/1993 |
| JP | 5042076 | A2 | 2/1993 |
| JP | 05046246 | | 2/1993 |
| JP | 5046246 | A2 | 2/1993 |
| JP | 5054620 | A2 | 3/1993 |
| JP | 5060049 | A2 | 3/1993 |
| JP | 05-084200 | | 4/1993 |
| JP | 5084200 | A2 | 4/1993 |
| JP | 5091604 | A2 | 4/1993 |
| JP | 5150827 | A2 | 6/1993 |
| JP | 5150829 | A2 | 6/1993 |
| JP | 05-054620 | | 7/1993 |
| JP | 5054620 | U | 7/1993 |
| JP | 5257527 | A2 | 10/1993 |
| JP | 5285861 | A2 | 11/1993 |
| JP | 06-003251 | | 1/1994 |
| JP | 6003251 | U1 | 1/1994 |
| JP | 06-038912 | | 2/1994 |

(56) References Cited

FOREIGN PATENT DOCUMENTS

| | | | |
|---|---|---|---|
| JP | 6026312 | A2 | 2/1994 |
| JP | 6105781 | A2 | 4/1994 |
| JP | 06125861 | A | 5/1994 |
| JP | 6137828 | A2 | 5/1994 |
| JP | 6293095 | A2 | 10/1994 |
| JP | 06-327598 | | 11/1994 |
| JP | 6-327598 | A | 11/1994 |
| JP | 07-047046 | | 2/1995 |
| JP | 7047046 | | 2/1995 |
| JP | 07-059702 | | 3/1995 |
| JP | 7059702 | A2 | 3/1995 |
| JP | 07032752 | B2 | 4/1995 |
| JP | 07-129239 | | 5/1995 |
| JP | 07-222705 | | 8/1995 |
| JP | 7222705 | A2 | 8/1995 |
| JP | 07-281742 | | 10/1995 |
| JP | 07-281752 | | 10/1995 |
| JP | 7270518 | A2 | 10/1995 |
| JP | 7281742 | A2 | 10/1995 |
| JP | 7281752 | A2 | 10/1995 |
| JP | 07-295636 | | 11/1995 |
| JP | 07-295638 | | 11/1995 |
| JP | 07-311041 | | 11/1995 |
| JP | 7295636 | A2 | 11/1995 |
| JP | 7295638 | A2 | 11/1995 |
| JP | 7311041 | A2 | 11/1995 |
| JP | 07-313417 | | 12/1995 |
| JP | 07-319542 | | 12/1995 |
| JP | 07-334242 | | 12/1995 |
| JP | 7313417 | A2 | 12/1995 |
| JP | 7319542 | A2 | 12/1995 |
| JP | 7334242 | A2 | 12/1995 |
| JP | 08-016241 | | 1/1996 |
| JP | 08-016776 | | 1/1996 |
| JP | 8000393 | B2 | 1/1996 |
| JP | 8016241 | A2 | 1/1996 |
| JP | 8016776 | B2 | 2/1996 |
| JP | 08-063229 | | 3/1996 |
| JP | 8063229 | A2 | 3/1996 |
| JP | 8083125 | A2 | 3/1996 |
| JP | 08-089451 | | 4/1996 |
| JP | 8-89451 | A | 4/1996 |
| JP | 8089449 | A2 | 4/1996 |
| JP | 08-123548 | | 5/1996 |
| JP | 2520732 | | 5/1996 |
| JP | 2520732 | B2 | 5/1996 |
| JP | 8123548 | A2 | 5/1996 |
| JP | 08-152916 | | 6/1996 |
| JP | 8-152916 | A | 6/1996 |
| JP | 8152916 | A2 | 6/1996 |
| JP | 08-256960 | | 10/1996 |
| JP | 08-263137 | | 10/1996 |
| JP | 8256960 | A2 | 10/1996 |
| JP | 8263137 | A2 | 10/1996 |
| JP | 08-286741 | | 11/1996 |
| JP | 08-286744 | | 11/1996 |
| JP | 08-286745 | | 11/1996 |
| JP | 08-286747 | | 11/1996 |
| JP | 8286741 | A2 | 11/1996 |
| JP | 8286744 | A2 | 11/1996 |
| JP | 8286745 | A2 | 11/1996 |
| JP | 8286747 | A2 | 11/1996 |
| JP | 08-322774 | | 12/1996 |
| JP | 08-335112 | | 12/1996 |
| JP | 8322774 | A2 | 12/1996 |
| JP | 8335112 | A2 | 12/1996 |
| JP | 8339297 | A2 | 12/1996 |
| JP | 09-043901 | | 2/1997 |
| JP | 09-047413 | | 2/1997 |
| JP | 9043901 | A2 | 2/1997 |
| JP | 9044240 | A2 | 2/1997 |
| JP | 9047413 | A2 | 2/1997 |
| JP | 09-066855 | | 3/1997 |
| JP | 9066855 | A2 | 3/1997 |
| JP | 09-160644 | | 6/1997 |
| JP | 9145309 | A2 | 6/1997 |
| JP | 9160644 | A2 | 6/1997 |
| JP | 07-338573 | | 7/1997 |
| JP | 08-000393 | | 7/1997 |
| JP | 09-179625 | | 7/1997 |
| JP | 09-179685 | | 7/1997 |
| JP | 09-185410 | | 7/1997 |
| JP | 9179625 | A2 | 7/1997 |
| JP | 9179685 | A2 | 7/1997 |
| JP | 9192069 | A2 | 7/1997 |
| JP | 09-204223 | | 8/1997 |
| JP | 09-204224 | | 8/1997 |
| JP | 09-206258 | | 8/1997 |
| JP | 2555263 | | 8/1997 |
| JP | 9204223 | A2 | 8/1997 |
| JP | 9204224 | A2 | 8/1997 |
| JP | 9206258 | A2 | 8/1997 |
| JP | 09-251318 | | 9/1997 |
| JP | 9233712 | A2 | 9/1997 |
| JP | 09248261 | A | 9/1997 |
| JP | 09251318 | | 9/1997 |
| JP | 9251318 | A2 | 9/1997 |
| JP | 09-265319 | | 10/1997 |
| JP | 09-269807 | | 10/1997 |
| JP | 09-269810 | | 10/1997 |
| JP | 09-269824 | | 10/1997 |
| JP | 9265319 | A2 | 10/1997 |
| JP | 9269807 | A2 | 10/1997 |
| JP | 9269810 | A2 | 10/1997 |
| JP | 9269824 | A2 | 10/1997 |
| JP | 09-319431 | | 12/1997 |
| JP | 09-319432 | | 12/1997 |
| JP | 09-319434 | | 12/1997 |
| JP | 09-325812 | | 12/1997 |
| JP | 9319431 | A2 | 12/1997 |
| JP | 9319432 | A2 | 12/1997 |
| JP | 9319434 | A2 | 12/1997 |
| JP | 9325812 | A2 | 12/1997 |
| JP | 10-027020 | | 1/1998 |
| JP | 10-055215 | | 2/1998 |
| JP | 10-105233 | | 4/1998 |
| JP | 10-117973 | | 5/1998 |
| JP | 10-118963 | | 5/1998 |
| JP | 10117973 | A2 | 5/1998 |
| JP | 10177414 | A2 | 6/1998 |
| JP | 10-214114 | | 8/1998 |
| JP | 10-228316 | | 8/1998 |
| JP | 3375843 | | 8/1998 |
| JP | 10214114 | A2 | 8/1998 |
| JP | 10228316 | | 8/1998 |
| JP | 10-240342 | | 9/1998 |
| JP | 10-240343 | | 9/1998 |
| JP | 10-260727 | | 9/1998 |
| JP | 10240342 | A2 | 9/1998 |
| JP | 10260727 | A2 | 9/1998 |
| JP | 10-295595 | | 11/1998 |
| JP | 11-015941 | | 1/1999 |
| JP | 11-065655 | | 3/1999 |
| JP | 11-065657 | | 3/1999 |
| JP | 11-085269 | | 3/1999 |
| JP | 11065655 | A2 | 3/1999 |
| JP | 11085269 | A2 | 3/1999 |
| JP | 11-102219 | | 4/1999 |
| JP | 11-102220 | | 4/1999 |
| JP | 11102219 | A2 | 4/1999 |
| JP | 11-162454 | | 6/1999 |
| JP | 11-174145 | | 7/1999 |
| JP | 11-175149 | | 7/1999 |
| JP | 11-212642 | | 8/1999 |
| JP | 11-213157 | | 8/1999 |
| JP | 11-508810 | | 8/1999 |
| JP | 11212642 | A2 | 8/1999 |
| JP | 11-510935 | | 9/1999 |
| JP | 11248806 | A2 | 9/1999 |
| JP | 11-295412 | | 10/1999 |
| JP | 11282533 | A2 | 10/1999 |
| JP | 11346964 | A2 | 12/1999 |
| JP | 2000-056006 | | 2/2000 |
| JP | 2000-056831 | | 2/2000 |

(56) References Cited

FOREIGN PATENT DOCUMENTS

| | | | |
|---|---|---|---|
| JP | 2000047728 | A2 | 2/2000 |
| JP | 2000-066722 | | 3/2000 |
| JP | 2000-075925 | | 3/2000 |
| JP | 2000-102499 | | 4/2000 |
| JP | 2000102499 | | 4/2000 |
| JP | 10240343 | A2 | 5/2000 |
| JP | 2000-279353 | | 10/2000 |
| JP | 2000275321 | A2 | 10/2000 |
| JP | 2000279353 | | 10/2000 |
| JP | 2000-342497 | | 12/2000 |
| JP | 2000-353014 | | 12/2000 |
| JP | 2000342497 | | 12/2000 |
| JP | 2000353014 | A2 | 12/2000 |
| JP | 2001-022443 | | 1/2001 |
| JP | 2001022443 | A2 | 1/2001 |
| JP | 2002-78650 | A | 3/2001 |
| JP | 2001067588 | A2 | 3/2001 |
| JP | 2001-087182 | | 4/2001 |
| JP | 2001087182 | | 4/2001 |
| JP | 2001121455 | A2 | 5/2001 |
| JP | 2001125641 | A2 | 5/2001 |
| JP | 2001216482 | A2 | 8/2001 |
| JP | 2001-258807 | | 9/2001 |
| JP | 2001-258807 | A | 9/2001 |
| JP | 2001-265437 | | 9/2001 |
| JP | 2001-275908 | | 10/2001 |
| JP | 2001-275908 | A | 10/2001 |
| JP | 2001289939 | A2 | 10/2001 |
| JP | 2001306170 | A2 | 11/2001 |
| JP | 2001320781 | A2 | 11/2001 |
| JP | 2001-525567 | | 12/2001 |
| JP | 2002-078650 | | 3/2002 |
| JP | 2002078650 | A2 | 3/2002 |
| JP | 2002-204768 | | 7/2002 |
| JP | 2002204769 | A2 | 7/2002 |
| JP | 2002247510 | A2 | 8/2002 |
| JP | 2002-532178 | | 10/2002 |
| JP | 2002-532178 | A | 10/2002 |
| JP | 2002-532180 | | 10/2002 |
| JP | 2002-533797 | | 10/2002 |
| JP | 2002532180 | | 10/2002 |
| JP | 2002533797 | T2 | 10/2002 |
| JP | 2002-323925 | | 11/2002 |
| JP | 2002-333920 | | 11/2002 |
| JP | 2002-355206 | | 12/2002 |
| JP | 2002-355206 | A | 12/2002 |
| JP | 2002-360471 | | 12/2002 |
| JP | 2002-360471 | A | 12/2002 |
| JP | 2002-360479 | | 12/2002 |
| JP | 2002-360482 | | 12/2002 |
| JP | 2002-360482 | A | 12/2002 |
| JP | 3356170 | | 12/2002 |
| JP | 2002366227 | A2 | 12/2002 |
| JP | 2002369778 | A2 | 12/2002 |
| JP | 2003-010076 | | 1/2003 |
| JP | 2003-10076 | A | 1/2003 |
| JP | 2003-010088 | | 1/2003 |
| JP | 2003-015740 | | 1/2003 |
| JP | 2003-05296 | | 2/2003 |
| JP | 2003-036116 | | 2/2003 |
| JP | 2003-038401 | | 2/2003 |
| JP | 2003-38401 | A | 2/2003 |
| JP | 2003-038402 | | 2/2003 |
| JP | 2003-38402 | A | 2/2003 |
| JP | 2003-052596 | | 2/2003 |
| JP | 2003-505127 | | 2/2003 |
| JP | 2003-505127 | A | 2/2003 |
| JP | 2003038401 | A2 | 2/2003 |
| JP | 2003038402 | A2 | 2/2003 |
| JP | 2003-061882 | | 3/2003 |
| JP | 2003084994 | A2 | 3/2003 |
| JP | 2003-167628 | | 6/2003 |
| JP | 2003/180586 | | 7/2003 |
| JP | 2003180587 | A2 | 7/2003 |
| JP | 2003186539 | A2 | 7/2003 |
| JP | 2003190064 | A2 | 7/2003 |
| JP | 1139847 | B1 | 8/2003 |
| JP | 2003241836 | A2 | 8/2003 |
| JP | 2003/262520 | | 9/2003 |
| JP | 2003/304992 | | 10/2003 |
| JP | 2003285288 | A2 | 10/2003 |
| JP | 2003-310489 | | 11/2003 |
| JP | 2003/310509 | | 11/2003 |
| JP | 2003330543 | A2 | 11/2003 |
| JP | 2004123040 | | 4/2004 |
| JP | 2004/148021 | | 5/2004 |
| JP | 2004160102 | | 6/2004 |
| JP | 2004174228 | | 6/2004 |
| JP | 2004198330 | A2 | 7/2004 |
| JP | 2004351234 | A2 | 12/2004 |
| JP | 2005118354 | A2 | 5/2005 |
| JP | 2005135400 | | 5/2005 |
| JP | 2005230032 | A2 | 9/2005 |
| JP | 2005245916 | | 9/2005 |
| JP | 2005296511 | A2 | 10/2005 |
| JP | 2005/352707 | | 12/2005 |
| JP | 2005346700 | | 12/2005 |
| JP | 2005346700 | A2 | 12/2005 |
| JP | 2006/043071 | | 2/2006 |
| JP | 2006079145 | | 3/2006 |
| JP | 2006079157 | | 3/2006 |
| JP | 2006/155274 | | 6/2006 |
| JP | 2006227673 | A2 | 8/2006 |
| JP | 2006247467 | | 9/2006 |
| JP | 2006260161 | | 9/2006 |
| JP | 2006293662 | | 10/2006 |
| JP | 2006296697 | | 11/2006 |
| JP | 2007/034866 | | 2/2007 |
| JP | 2007213180 | | 8/2007 |
| JP | 2009015611 | | 1/2009 |
| JP | 2010198552 | | 9/2010 |
| WO | 95/26512 | | 10/1995 |
| WO | WO9526512 | A1 | 10/1995 |
| WO | WO9530887 | A1 | 11/1995 |
| WO | WO9617258 | A2 | 6/1996 |
| WO | 97/15224 | | 5/1997 |
| WO | WO9715224 | A1 | 5/1997 |
| WO | 97/40734 | | 11/1997 |
| WO | 97/41451 | | 11/1997 |
| WO | WO9740734 | A1 | 11/1997 |
| WO | WO9741451 | A1 | 11/1997 |
| WO | 98/53456 | | 11/1998 |
| WO | WO9853456 | A1 | 11/1998 |
| WO | WO9905580 | A2 | 2/1999 |
| WO | 99/16078 | | 4/1999 |
| WO | WO9916078 | A1 | 4/1999 |
| WO | 99/28800 | | 6/1999 |
| WO | WO9928800 | A1 | 6/1999 |
| WO | 99/38056 | | 7/1999 |
| WO | 99/38237 | | 7/1999 |
| WO | WO9938056 | A1 | 7/1999 |
| WO | WO9938237 | A1 | 7/1999 |
| WO | 99/43250 | | 9/1999 |
| WO | WO9943250 | A1 | 9/1999 |
| WO | 99/59042 | | 11/1999 |
| WO | WO9959042 | A1 | 11/1999 |
| WO | 00/04430 | | 1/2000 |
| WO | WO0004430 | A1 | 1/2000 |
| WO | 00/36962 | | 6/2000 |
| WO | 00/38026 | | 6/2000 |
| WO | 00/38028 | | 6/2000 |
| WO | 00/38029 | | 6/2000 |
| WO | WO0036962 | A1 | 6/2000 |
| WO | WO0038026 | A1 | 6/2000 |
| WO | WO0038028 | A1 | 6/2000 |
| WO | WO0038029 | A1 | 6/2000 |
| WO | 00/78410 | | 12/2000 |
| WO | 00/78410 | A1 | 12/2000 |
| WO | WO0078410 | A1 | 12/2000 |
| WO | 01/06904 | | 2/2001 |
| WO | 01/06904 | A1 | 2/2001 |
| WO | 01/06905 | | 2/2001 |
| WO | WO0106904 | A1 | 2/2001 |
| WO | WO0106905 | A1 | 2/2001 |

(56) References Cited

FOREIGN PATENT DOCUMENTS

| | | | |
|---|---|---|---|
| WO | WO0180703 | A1 | 11/2001 |
| WO | WO0191623 | A2 | 12/2001 |
| WO | WO0224292 | A1 | 3/2002 |
| WO | 02/39864 | | 5/2002 |
| WO | 02/39864 | A1 | 5/2002 |
| WO | 02/39868 | | 5/2002 |
| WO | 02/39868 | A1 | 5/2002 |
| WO | WO0239864 | A1 | 5/2002 |
| WO | WO0239868 | A1 | 5/2002 |
| WO | 02/058527 | | 8/2002 |
| WO | 02/058527 | A1 | 8/2002 |
| WO | 02/062194 | | 8/2002 |
| WO | 02/067744 | | 9/2002 |
| WO | 02/067744 | A1 | 9/2002 |
| WO | 02/067745 | | 9/2002 |
| WO | 02/067745 | A1 | 9/2002 |
| WO | 02/067752 | | 9/2002 |
| WO | 02/069775 | | 9/2002 |
| WO | 02/071175 | | 9/2002 |
| WO | 02/074150 | | 9/2002 |
| WO | 02/074150 | A1 | 9/2002 |
| WO | 02/075356 | | 9/2002 |
| WO | 02/075356 | A1 | 9/2002 |
| WO | 02/075469 | | 9/2002 |
| WO | 02/075469 | A1 | 9/2002 |
| WO | 02/075470 | | 9/2002 |
| WO | 02/075470 | A1 | 9/2002 |
| WO | WO02067752 | A1 | 9/2002 |
| WO | WO02069774 | A1 | 9/2002 |
| WO | WO02069775 | A2 | 9/2002 |
| WO | WO02074150 | A1 | 9/2002 |
| WO | WO02075350 | A1 | 9/2002 |
| WO | WO02081074 | A1 | 10/2002 |
| WO | 02/101477 | | 12/2002 |
| WO | 03/024292 | | 3/2003 |
| WO | 03/026474 | | 4/2003 |
| WO | 03/026474 | A2 | 4/2003 |
| WO | 03/040546 | | 5/2003 |
| WO | 03/040845 | | 5/2003 |
| WO | 03/040845 | A1 | 5/2003 |
| WO | 03/040846 | | 5/2003 |
| WO | 03/040846 | A1 | 5/2003 |
| WO | 2004/004533 | | 1/2004 |
| WO | 2004/006034 | | 1/2004 |
| WO | WO2004004534 | A1 | 1/2004 |
| WO | WO2004006134 | A1 | 1/2004 |
| WO | WO 2004/043215 | | 5/2004 |
| WO | 2004/058028 | | 7/2004 |
| WO | 2004/059409 | | 7/2004 |
| WO | 2004058028 | | 7/2004 |
| WO | 2005/006935 | | 1/2005 |
| WO | WO 2005/036292 | | 4/2005 |
| WO | 2005/055795 | | 6/2005 |
| WO | 2005/055796 | | 6/2005 |
| WO | 2005/077244 | | 8/2005 |
| WO | WO2005076545 | A1 | 8/2005 |
| WO | WO2005077243 | A1 | 8/2005 |
| WO | 2005/082223 | | 9/2005 |
| WO | 2005082223 | A1 | 9/2005 |
| WO | WO2005083541 | A1 | 9/2005 |
| WO | WO2005098475 | A1 | 10/2005 |
| WO | WO2005098476 | A1 | 10/2005 |
| WO | WO2006046400 | A1 | 5/2006 |
| WO | 2006/061133 | | 6/2006 |
| WO | 2006/068403 | | 6/2006 |
| WO | 2006/073248 | | 7/2006 |
| WO | 2007/036490 | | 4/2007 |
| WO | WO2007065033 | A2 | 6/2007 |
| WO | 2007/137234 | | 11/2007 |

OTHER PUBLICATIONS

Doty, Keith L et al., "Sweep Strategies for a Sensory-Driven, Behavior-Based Vacuum Cleaning Agent" AAAI 1993 Fall Symposium Series Instantiating Real-World Agents Research Triangle Park, Raleigh, NC, Oct. 22-24, 1993, pp. 1-6.

Electrolux, "Facts on the Trilobite," http://trilobiteelectroluxse/presskit_en/node1335.asp?print=yes&pressID=, accessed Dec. 12, 2003 (2 pages).

Electrolux designed for the well-lived home, website: http://www.electroluxusa.com/node57.as?currentURL=node142.asp%3F, accessed Mar. 18, 2005, 5 pgs.

eVac Robotic Vacuum S1727 Instruction Manual, Sharper Image Corp, Copyright 2004, 16 pgs.

Evolution Robotics, "NorthStar—Low-cost Indoor Localization, How it Works," E Evolution robotics , 2 pages, 2005.

Everyday Robots, website: http://www.everydayrobots.com/index.php?option=content&task=view&id=9, accessed Apr. 20, 2005, 7 pgs.

Friendly Robotics Robotic Vacuum RV400—The Robot Store website: http://www.therobotstore.com/s.nl/sc.9/category,-109/it.A/id.43/.f, accessed Apr. 20, 2005, 5 pgs.

Gat, Erann, "Robust Low-computation Sensor-driven Control for Task-Directed Navigation," Proceedings of the 1991 IEEE, International Conference on Robotics and Automation, Sacramento, California, Apr. 1991, pp. 2484-2489.

Hitachi, News release, The home cleaning robot of the autonomous movement type (experimental machine) is developed, website: http://www.i4u.com/japanreleases/hitachirobot.htm, accessed Mar. 18, 2005, 5 pgs.

Kahney, "Wired News: Robot Vacs are in the House," website: http://www.wired.com/news/print/0,1294,59237,00.html, accessed Mar. 18, 2005, 6 pgs.

Karcher Product Manual Download webpage: "http://ww-wkarchercom/bta/downloadenshtml?ACTION=SELECTTEILENR&ID=rc3000&-submitButtonName=Select+Product+Manual" and associated pdf file "5959-915enpdf (47 MB) English/English" accessed Jan. 21, 2004.

Karcher RC 3000 Cleaning Robot—user manual Manufacturer: Alfred-Karcher GmbH & Co, Cleaning Systems, Alfred Karcher—Str 28-40, PO Box 160, D-71349 Winnenden, Germany, Dec. 2002.

Karcher, "Karcher RoboCleaner RC 3000 Product Details," http://www.robocleaner.de/english/screen3.html, 4 pages, accessed Dec. 12, 2003.

Karcher USA, RC3000 Robotic Cleaner, website: http://www.karcher-usa.com/showproducts.php?op=view_prod&Param1=143&param2=&param3=, accessed Mar. 18, 2005, 6 pgs.

Koolvac Robotic Vacuum Cleaner Owner's Manual, Koolatron, Undated, 26 pgs.

Put Your Roomba . . . On "Automatic" Roomba Timer> Timed Cleaning—Floorvac Robotic Vacuum webpages: http://cgi.ebay. com/ws/eBayISAPI.dll?ViewItem&category=43575198387&rd=1, accessed Apr. 20, 2005, 5 pgs.

Put Your Roomba . . . On "Automatic" webpages: "http://www.acomputeredge.com/roomba," accessed Apr. 20, 2005, 5 pgs.

The Robo Maid, "RoboMaid Sweeps Your Floors So You Won't Have To," the Official Website, http://www.robomaid.com, 2 pages, accessed Mar. 18, 2005.

Robot Review Samsung Robot Vacuum (VC-RP30W), website: http://www.onrobo.com/reviews/At_Home/Vacuum_Cleaners/on00vcrp30rosam/index.htm, accessed Mar. 18, 2005, 11 pgs.

Robotic Vacuum Cleaner—Blue, website: http://www.sharperimage.com/us/en/catalog/productview.jhtml?sku—S1727BLU, accessed Mar. 18, 2005, 3 pgs.

Schofield, Monica, "Neither Master nor Slave, A Practical Study in the Development and Employment of Cleaning Robots,", 1999 Proceedings EFA '99 1999 7th IEEE International Conference on Emerging Technologies and Factory Automation, vol. 2, Barcelona, Spain Oct. 18-21, 1999, pp. 1427-1434, 1999.

Zoombot Remote Controlled Vacuum—RV-500 New Roomba 2, website: http://egi.ebay.com/ws/eBay|SAP|.dll?ViewItem&category=43526&item=4373497618&rd=1, accessed Apr. 20, 2005, 7 pgs.

U.S. Office Action dated Aug. 27, 2004 for U.S. Appl. No. 10/320,729.

U.S. Office Action dated May 7, 2008 for U.S. Appl. No. 10/818,073.

U.S. Office Action dated Jan. 7, 2009 for U.S. Appl. No. 10/818,073.

(56) References Cited

OTHER PUBLICATIONS

U.S. Office Action dated Feb. 28, 2008 for U.S. Appl. No. 11/834,606.
U.S. Office Action dated Jul. 28, 2008 for U.S. App. No. 11/834,656.
U.S. Office Action dated Jan. 26, 2009 for U.S. Appl. No. 11/834,656.
Examination Report dated Aug. 2, 2010 from corresponding U.S. Appl. No. 11/751,413.
Examination Report dated Dec. 2, 2010 from corresponding U.S. Appl. No. 11/751,267.
Examination Report dated Apr. 13, 2010 from corresponding U.S. Appl. No. 11/751,267.
Examination Report dated May 27, 2010 from corresponding U.S. Appl. No. 11/751,470.
Examination Report dated Jun. 9, 2010 from corresponding U.S. Appl. No. 11/835,355.
Examination Report dated Sep. 14, 2009 from corresponding U.S. Appl. No. 11/835,355.
Examination Report dated Oct. 26, 2009 from corresponding U.S. Appl. No. 11/835,361.
Examination Report dated Jul. 28, 2010 from corresponding U.S. Appl. No. 12/610,792.
U.S. Appl. No. 11/834,606 filed Aug. 6, 2007.
U.S. Appl. No. 11/834,656 filed Aug. 10, 2007.
International Search Report and Written Opinion dated Dec. 2, 2010 for PCT/US2010/045502.
International Search Report and Written Opinion dated Feb. 18, 2009 for PCT/US2008/063174.
Examination Report dated Aug. 17, 2010 from corresponding EP Application No. 07783998.3.
Japanese Office Action from corresponding application JP 2003-403161, dated Dec. 2, 2008, along with an English language translation thereof.
Japanese Office Action from corresponding application JP 2003-403161, dated Jun. 23, 2009, along with an English language translation thereof.
Japanese Office Action from corresponding application JP 2003-403161, dated Feb. 2010, along with an English language translation thereof.
Japanese Office Action from corresponding application JP 2003-403161, dated Nov. 5, 2010, along with an English language translation thereof.
Prassler, E. et al., "A Short History of Cleaning Robots", Autonomous Robots, vol. 9, pp. 211-226, 2000.
Japanese Office Action from corresponding application JP 2010-284344, dated Feb. 4, 2011, along with an English language translation thereof.
English Language translation of JP 05-054620.
Office Action from U.S. Appl. No. 12/824,804, dated Apr. 14, 2011.
Office Action from U.S. Appl. No. 12/824,804, dated Aug. 2, 2010.
Office Action from U.S. Appl. No. 12/824,832, dated Nov. 10, 2010.
Office Action from U.S. Appl. No. 10/818,073, dated Jan. 8, 2008.
Office Action from U.S. Appl. No. 12/201,554, dated Jun. 16, 2009.
Office Action from U.S. Appl. No. 12/201,554, dated Jan. 14, 2010.
Office Action from U.S. Appl. No. 11/834,656, dated Apr. 16, 2008.
Office Action from U.S. Appl. No. 11/834,647, dated May 16, 2008.
Office Action from U.S. Appl. No. 11/834,647, dated Oct. 31, 2008.
Office Action from U.S. Appl. No. 11/834,647, dated Mar. 6, 2009.
Office Action from U.S. Appl. No. 11/834,647, dated Sep. 9, 2009.
Notice of Allowance from U.S. Appl. No. 10/320,729, dated Jan. 7, 2005.
Notice of Allowance from U.S. Appl. No. 10/818,073, dated May 4, 2009.
Notice of Allowance from U.S. Appl. No. 11/834,606, dated Aug. 4, 2008.
Notice of Allowance from U.S. Appl. No. 11/834,656, dated Aug. 13, 2009.
Notice of Allowance from U.S. Appl. No. 11/834,647, dated Oct. 13, 2010.
Notice of Allowance from U.S. Appl. No. 11/834,647, dated Sep. 3, 2010.
Notice of Allowance from U.S. Appl. No. 11/834,647, dated May 20, 2010.
Notice of Allowance from U.S. Appl. No. 11/834,647, dated Feb. 1, 2010.
Office Action from U.S. Appl. No. 12/610,792, dated Feb. 16, 2011.
Office Action from U.S. Appl. No. 11/834,573, dated Nov. 23, 2009.
Office Action from U.S. Appl. No. 11/834,573, dated Mar. 23, 2009.
Kahney, L., Wired News: Robot Vacs are in the House, website http:/www.wired.com/news/print/0,1294,59237,00.html, accessed Mar. 18, 2005.
Thrun, S., Learning Occupancy Grid Maps with Forward Sensor Models, School of Computer Science, Carnegie Mellon University, pp. 1-28.
English language translation of EP 1380245, published Jan. 14, 2004.
English language translation of EP 1557730, published Jul. 27, 2005.
English language translation of JP 2003-061882, published Mar. 2003.
English language translation of WO 02/071175, published Sep. 12, 2002.
English language translation of WO 2004/058028, published Jul. 15, 2004.
English language translation of WO 2004/059409, published Jul. 15, 2004.
English language translation of WO 2005/055795, published Jun. 23, 2005.
English language translation of WO 2006/061133, published Jun. 15, 2006.
English language translation of WO 2006/068403, published Jun. 29, 2006.
English language translation of DE 10242257, published Apr. 24, 2003.
U.S. Appl. No. 60/605,066, filed Aug. 27, 2004.
U.S. Appl. No. 60/605,181, filed Aug. 27, 2004.
Euroflex Intellegente Monster manual, English language excerpt, cover and pp. 17-30, accessed Mar. 13, 2006.
Euroflex Monster, http://www.euroflex.tv/novita_dett.php?id=15 1 page, dated Jan. 1, 2006.
LG Roboking—Not Just a Vacuum Cleaner, a Robot!, http;//infocom.uz/2004/01/21/robokingne-prosto-pyilesos-a-robot/, Jan. 21, 2004, English version, 5 pages.
LG Roboking—Not Just a Vacuum Cleaner, a Robot!, http;//infocom.uz/2004/01/21/robokingne-prosto-pyilesos-a-robot/, Jan. 21, 2004, foreign language version, 7 pages.
LG Announces the First Robotic Vacuum Cleaner of Korea, Robot Buying Guide, http://robotbg.com/news/2003/04/22/lg_announces_the_first_robotic_vacuum_cleaner_of_korea, 1 page, Apr. 21, 2003.
Robo Vac, Arbeitet ohne Aufsicht, Maschinemarkt, Wurzburg 105 (1999) 27, 3 pages, dated Jul. 5, 1999.
Karcher Robot Vacuum Cleaner, SVET Kompjutera SK Web 2:54, English version, dated Oct. 1999, 1 page, copyright date 1984-2011.
Karcher Robot usisivac SVET Kompujutera http://www.sk.rs/1999/10/sknt01.html, foreign language version, 1 page, dated Oct. 1999, copyright date 1984-2011.
LG RoboKing V-R4000, http://www.popco.net/zboard/view.php?id=tr_review&no=40, Aug. 5, 2005, 15 pages, copyright date 1999-2011.
Dome Style Robot Room Cleaner, http://www.rakuten.co.jp/matsucame/587179/711512/, 7 pages.
Dyson's Robot Vacuum Cleaner—the DC06, http://www.gizmag.com/go/1282/ 3 pages, dated May 2, 2004.
Electrolux Trilobite ZA1, http://www.electrolux-ui.com:8080/2002%5C822%5C833102EN.pdf 10 pages, dated Jan. 12, 2001.
Electrolux Trilobite, http://www.robocon.co.kr/trilobite/Presentation_Trilobite_Kor_030104.ppt 19 pages.
Electrolux Trilobite, web site Sep. 2002, http://www.frc.ri.cmu.edu/~hpm/talks/Extras/trilobite.desc.html 2 pages, dated Sep. 2002.
Floorbotics VR-8 Floor Cleaning Robot, http://www.consensus.com.au/SoftwareAwards/CSAarchive/CSA2004/CSAart04/FloorBot/FX1%20Product%20Description%2020%20January%202004.pdf, v.20040120 (2004), 11 pages.
Hitachi Robot Cleaner, It's eye, www.hitachi.co.jp/rd/pdf/topics/hitac2003_10.pdf, Oct. 2003, 2 pages, copyright date 2003.

(56) References Cited

OTHER PUBLICATIONS

Hitachi Robot Cleaner, http://www.hitachi.co.jp/New/cnews/hl_030529_hl_030529.pdf, 8 pages, dated May 29, 2003.
Friendly Robotics RV 400 Manual, http://www.robotsandrelax.com/PDFs/RV400Manual.pdf pp. 1-18. dated 2004.
Metapo Clean Mate 365 Intelligent Automatic Vacuum Cleaner Model QQ-1 User Manual, www.metapo.com/support/user_manual.pdf 11 pages.
Microrobot UBot MR-UB01K, http://us.aving.net/news/view.php?articleId=23031 5 pages, dated Aug. 25, 2006.
Robotic Vacuum by Matsushita about to undergo Field Testing, http://www.taipeitimes.com/News/worldbWarchives/2002/03/26/0000129338 2 pages, dated Mar. 26, 2002, copyright date 1999-2011.
Matsushita robotic cleaner, http://techon.nikkeibp.co.jp/members/0ldb/200203/1006501/ 3 pages, dated Mar. 25, 2002, copyright date 1995-2011.
Matsushita robotic cleaner, http://ascii.jp/elem/000/000/330/330024/ 9 pages, dated Mar. 25, 2002.
Sanyo Robot Cleaner http://www.itmedia.co.jp/news/0111/16/robofesta_m.html dated 7 pages, Nov. 16, 2001.
Yujin Robotics, An Intelligent Cleaning Robot "Iclebo Q", http://us.aving.net/news/view.php?articleId=7257 8 pages, dated Sep. 2, 2005.
Vacuum Cleaner Robot Operated in Conjunction with 3G Cellular Phone, http://www.toshiba.co.jp/tech/review/2004/09/59_09pdf/a13.pdf pp. 53-55, dated 2004.
Toshiba prototype, http://warp.ndl.go.jp/info:ndljp/pid/258151/www.soumu.go.jp/joho_tsusin/policyreports/chousa/netrobot/pdf/030214_1_33_a.pdf, pp. 1-16, dated 2003.
Japanese Office Action from corresponding application JP 2010-133227, dated Nov. 18, 2011, along with an English language translation thereof.
Japanese Office Action from corresponding application JP 2010-133229, dated Nov. 18, 2011, along with an English language translation thereof.
Office Action from U.S. Appl. No. 12/824,832, dated Jul. 29, 2011.
Hitachi, "Feature," http://kadenfan.hitachi.co.jp/robot/feature/feature.html, 1 page, accessed Nov. 19, 2008, dated May 29, 2003.
Microrobot, "Home Robot—UBOT," http://www.microrobotusa.com/product_1_1_.html, 2 pages, accessed Dec. 2, 2008, copyright date 2007.
InMach, "Intelligent Machines," http://www.inmach.de/inside.html, 1 page, accessed Nov. 19, 2008.
Hammacher Schlemmer, "Electrolux Trilobite Robotic Vacuum at Hammacher Schlemmer," www.hammacher.com/publish/71579.asp?promo=xsells, 3 pages, accessed Mar. 18, 2005, copyright date 2004.
TotalVac.com, "Karcher RC3000 RoboCleaner Robot Vacuum at TotalVac," www.totalvac.com/robot_vacuum.htm, 3 pages, accessed Mar. 18, 2005, copyright date 2004.
MobileMag, Samsung unveils high-tech robot vacuum cleaner, http://www.mobilemag.com/content/100/102/C2261/, 4 pages, accessed Mar. 18, 2005, dated Nov. 25, 2003, copyright date 2002-2004.
Samsung unveils its multifunction robot vacuum,Samsung Robot Vacuum (VC-RP3OW), http://www.iirobotics.com/webpages/hotstuff.php?ubre=111, 3 pages, accessed Mar. 18, 2005, dated Aug. 31, 2004.
Samsung unveils it multifunction robot vacuum, http://www.onrobo.corn/enews/0210/samsung_vacuum.shtml, 3 pages, accessed Mar. 18, 2005, copyright date 2004.
Gregg, M. et al., "Autonomous Lawn Care Applications", 2006 Florida Conference on Recent Advances in Robotics, FCRAR May 25-26, 2006, pp. 1-5.
UAMA (Asia) Industrial Co. Ltd., "Robot Family," 1 page, indicates available in 2005.
Matsutek Enterprises Co. Ltd., "Automatic Rechargeable Vacuum Cleaner," http://matsutek.manufacturer.globalsources.com/si/6008801427181/pdtl/Home-vacuum/10, 3 pages, accessed Apr. 23, 2007, copyright date 2007.
Office Action from U.S. Appl. No. 11/671,305, dated Aug. 22, 2007.
LG, RoboKing, 4 pages.
Collection of pictures of robotic cleaners, devices AA-BF, 50 pages.
Braunstingl et al., "Fuzzy Logic Wall Following of a Mobile Robot Based on the Concept of General Perception," Sep. 1995, ICAR '95, 7th Int'l Conference on Advanced Robotics, Sant Feliu De Guixols, Spain, pp. 367-376.
Yata et al., "Wall Following Using Angle Information Measured by a Single Ultrasonic Transducer," Proceedings of the 1998 IEEE, International Conference on Robotics & Automation, Leuven, Belgium, pp. 1590-1596, May 1998.
Tse et al., "Design of a Navigation System for a Household Mobile Robot Using Neural Networks" Dept. of Manufacturing Engg. & Engg. Management, City University of Hong Kong, pp. 2151-2156, 1998.
Wolf, J. et al., "Robust Vision-Based Localization by Combining an Image-Retrieval System with Monte Carlo Localization", IEEE Transactions on Robotics, vol. 21, No. 2 pp. 208-216, Apr. 2005.
Eren et al., "Accuracy in Position Estimation of Mobile Robots Based on Coded Infrared Signal Transmission," Proceedings: Integrating Intelligent Instrumentation and Control, Instrumentation and Measurement Technology Conference, IMTC/95, pp. 548-551, 1995.
Karlsson, N. et al. "Core Technologies for Service Robotics", Proceedings of 2004 IEEE/RSJ International Conference on Intelligent Robots and Systems, Sep. 28-Oct. 2, 2004, Sendai Japan, pp. 2979-2984.
Leonard et al., "Mobile Robot Localization by Tracking Geometric Beacons," IEEE Transactions on Robotics and Automation, vol. 7, No. 3, pp. 376-382, Jun. 1991.
Paromtchik, "Toward Optical Guidance of Mobile Robots." Proceedings of the Fourth World Multiconference on Systemics, Cybernetics and Informatics, Orlando, FL, USA, Jul. 23-26, 2000, vol. IX, six pages.
Wong, EIED Online>>Robot Business, ED Online ID# 13114, 17 pages, Jul. 26, 2006, copyright date 2006.
Facchinetti et al., "Using and Learning Vision-Based Self-Positioning for Autonomous Robot Navigation," ICARCV '94, The Third International Conference on Automation, Robotics and Computer Vision, Singapore, vol. 3 pp. 1694-1698, Nov. 1994.
Facchinetti et al., "Self-Positioning Robot Navigation Using Ceiling Images Sequences," ACCV'95, pp. 1-5, Dec. 5-8, 1995.
King et al., "Heplmate-TM—Autonomous Mobile Robot Navigation System," SPIE, vol. 1388, Mobile Robots V, pp. 190-198, 1990.
Fairfield et al., "Mobile Robot Localization with Sparse Landmarks," Proceedings of SPIE, vol. 4573, pp. 148- 155, 2002.
Benayad-Cherif et al., "Mobile Robot Navigation Sensors," SPIE, vol. 1831, Mobile Robots VII pp. 378-387, 1992.
Friendly Robotics, "Friendly Robotics—Friendly Vac, Robotic Vacuum Cleaner," http://www.friendlyrobotics.com/vac.htm, 4 pages, accessed Apr. 20, 2005.
TheRobotStore.com, "Friendly Robotics Robotic Vacuum RV400—The Robot Store," http://www.therobotstore.com/s.nl/sc.9/category.-109/it.A/id.43/.f, 1 page, accessed Apr. 20, 2005.
The Sharper Image, E Vac Robotic Vacuum, http://www.sharperimage.com/us/en/templates/products/pipmorework1printable.jhtml, 1 page, accessed Mar. 18, 2005.
Welcome to the Electrolux Trilobite, Electrolux: Designed for the well-lived home, http://www.electroluxusa.com/node57.asp?currentURL=node142.asp%3F, 2 pages, accessed Mar. 18, 2005.
RC3000 Robotic Cleaner, Karcher USA, http://www.karcher- usa.com/showproducts.php?op=view_prod&param1=143&param2=&param3=, 3 pages, copyright date 2005.
On Robo, "Robot Reviews Samsung Robot Vacuum (VC-RP3OW)," http://www.onrobo.com/reviews/AT_Home/vacuum_cleaners/on00verb30rosam/index.htm. 2 pages, accessed Mar. 18, 2005, copyright date 2005.
e Vac Robotic Vacuum, #S1727BLU, Robotic Vacuum Cleaner Blue, Sharper Image, http://www.sharperimage.com/us/en/catalog/productview.jhtml?sku=S1727BLU, 2 pages, accessed Mar. 18, 2005, copyright date 2005.

(56) References Cited

OTHER PUBLICATIONS

Japanese Office Action from corresponding application JP 2009-133437, dated Jun. 6, 2011, along with an English language translation thereof.
Office Action from U.S. Appl. No. 12/824,785, dated Jun. 10, 2011.
Office Action from U.S. Appl. No. 12/211,938, dated Sep. 27, 2010.
Office Action from U.S. Appl. No. 11/633,869, dated Sep. 16, 2010.
Office Action from U.S. Appl. No. 11/541,422, dated Jul. 22, 2010.
Office Action from U.S. Appl. No. 11/682,642, dated Oct. 28, 2009.
Office Action from U.S. Appl. No. 11/682,642, dated Jul. 13, 2010.
Office Action from U.S. Appl. No. 11/166,986, dated Oct. 25, 2008.
Office Action from U.S. Appl. No. 11/166,986, dated May 12, 2009.
Office Action from U.S. Appl. No. 11/166,986, dated Sep. 4, 2009.
Office Action from U.S. Appl. No. 12/971,281, dated Jun. 24, 2011.
Jarosiewicz, EEL 5666 Intelligent Machine Design Laboratory, Aug. 4, 1999, 50 pages.
Office Action from U.S. Appl. No. 12/824,804, dated Jan. 4, 2012.
Notice of Allowance from U.S. Appl. No. 11/834,647, dated Jan. 5, 2012.
Japanese Office Action from corresponding application JP 2010-133228, dated Jan. 5, 2012, along with an English language translation thereof.
Machine generated translation of JP U 5-54620, dated Jul. 23, 1993.
Abstract and machine generated translation of JP 2002-360479.
Facts on the Trilobite http://www.frc.ri.cmu.edu/~hpm/talks/Extras/trilobite.desc.html 2 pages accessed Nov. 1, 2011.
Florbot GE Plastics, 1989-1990, 2 pages, available at http://www.fuseid.com/, accessed Sep. 27, 2012.
Fuentes, et al. "Mobile Robotics 1994", University of Rochester. Computer Science Department, TR 588, 44 pages, Dec. 7, 1994.
Grumet "Robots Clean House", Popular Mechanics, Nov. 2003.
http://www.karcher.de/versions/int/assets/video/2_4_robo_en.swf$_{13}$ Accessed Sep. 25, 2009.
Koolatron "KOOLVAC—Owner's Manual", 13 pages.
Robovacc1999.
Andersen et al., "Landmark based navigation strategies", SPIE Conference on Mobile Robots XIII, SPIE vol. 3525, pp. 170-181, Jan. 8, 1999.
Ascii, Mar. 25, 2002, http://ascii.jp/elem/000/000/330/330024/ accessed Nov. 1, 2011.
Certified copy of U.S. Appl. No. 60/605,066 as provided to WIPO in PCT/US2005/030422, corresponding to U.S. National Stage Entry Appl. No. 11/574,290, U.S. publication 2008/0184518, filed Aug. 27, 2004.
Certified copy of U.S. Appl. No. 60/605,181 as provided to WIPO in PCT/US2005/030422, corresponding to U.S. National Stage Entry U.S. Appl. No. 11/574,290, U.S. publication 2008/0184518, filed Aug. 27, 2004.
Derek Kurth, "Range-Only Robot Localization and SLAM with Radio", http://www.ri.cmu.edu/pubfiles/pub4/kurth_derek_2004_1/kurth_derek_2004_1.pdf. 60 pages, May, 2004, accessed Jul. 27, 2012.
Electrolux Trilobite, Jan. 12, 2001, http://www.electrolux-ui.com:8080/2002%5C822%5C833102EN.pdf, accessed Jul. 2, 2012, 10 pages.
Florbot Ge Plastics, 1989-1990, 2 pages, 27, 2012. available at http://www.fuseid.com/, accessed Sep. 27, 2012.
Gregg et al., "Autonomous Lawn Care Applications," 2006 Florida Conference on Recent Advances in Robotics, Miami, Florida, May 25-26, 2006, Florida International University, 5 pages.
Hitachi 'Feature', http://kadenfan.hitachi.co.jp/robot/feature/feature.html, 1 page, Nov. 19, 2008.
Hitachi, http://www.hitachi.co.jp/New/cnews/hi_030529_hi_030529.pdf, 8 pages, May 29, 2003.
Home Robot—UBOT; Microbotusa.com, retrieved from the WWW at www.microrobotusa.com, accessed Dec. 2, 2008.
King and Weiman, "Helpmate™ Autonomous Mobile Robots Navigation Systems," SPIE vol. 1388 Mobile Robots, pp. 190-198 (1990).
Li, Z.; Trappe, W.; Zhang, Y.; Badri Nath; , "Robust statistical methods for securing wireless localization in sensor networks," Information Processing in Sensor Networks, 2005. IPSN 2005. Fourth International Symposium on , vol., No., pp. 91-98, Apr. 15, 2005.
Yuri V. Martishevcky, "Accuracy of point light target coordinate determination by dissectoral tracking system", Proc. SPIE 2591, 25 (1995) (Oct. 23, 1995).
Maschinemarkt Wiirzburg 105, Nr. 27, pp. 3, 30, Jul. 5, 1999.
Miwako Doi "Using the symbiosis of human and robots from approaching Research and Development Center," Toshiba Corporation, 16 pages, available at http://warp.ndl.go.jp/info:ndljp/pid/258151/www.soumu.go.jp/joho_tsusin/policyreports/chousa/netrobot/pdf/030214_33_a.pdf, Feb. 26, 2003.
Paromtchik "Toward Optical Guidance of Mobile Robots," Proceedings of the Fourth World Multiconference on Systemics, Cybermetics and Informatics, Orlando, FL, USA, Jul. 23, 2000, vol. IX, pp. 44-49, available at http://emotion.inrialpes.fr/~paromt/infos/papers/paromtchik:asama:sci:2000.ps.gz, accessed Jul. 3, 2012.
Roboking—not just a vacuum cleaner, a robot!, Jan. 21, 2004, infocom.uz/2004/01/21/robokingne-prosto-pyilesos-a-robot/, accessed Oct. 10, 2011, 7 pages.
Sebastian Thrun, "Learning Occupancy Grid Maps With Forward Sensor Models," Autonomous Robots 15, 111-127, Sep. 1, 2003.
SVET Computers—New Technologies—Robot Vacuum Cleaner, Oct. 1999, available at http://www.sk.rs/1999/10/sknt01.html, accessed Nov. 1, 2011.
Written Opinion of the International Searching Authority, PCT/US2004/001504, Aug. 20, 2012, 9 pages.

* cited by examiner

AUTONOMOUS FLOOR-CLEANING ROBOT

CROSS-REFERENCE TO RELATED APPLICATIONS

This application for U.S. patent is a continuation of U.S. patent application Ser. No. 12/201,554 filed Aug. 29, 2008, which is a division of U.S. patent application Ser. No. 10/818,073 filed Apr. 5, 2004, now U.S. Pat. No. 7,571,511, which is a continuation of U.S. patent application Ser. No. 10/320,729 filed Dec. 16, 2002, now U.S. Pat. No. 6,883,201, which claims the benefit of U.S. Provisional Application No. 60/345,764 filed on Jan. 3, 2002, the contents of all of which are expressly incorporated by reference herein in their entireties. The subject matter of this application is also related to commonly-owned U.S. patent application Ser. No. 09/768,773 filed Jan. 24, 2001, now U.S. Pat. No. 6,594,844, U.S. patent application Ser. No. 10/167,851 filed Jun. 12, 2002, now U.S. Pat. No. 6,809,490, and U.S. patent application Ser. No. 10/056,804 filed Jan. 24, 2002, U.S. Pat. No. 6,690,134, which are all expressly incorporated by reference herein in their entireties.

BACKGROUND OF THE INVENTION (1) Field of the Invention

The present invention relates to cleaning devices, and more particularly, to an autonomous floor-cleaning robot that comprises a self-adjustable cleaning head subsystem that includes a dual-stage brush assembly having counter-rotating, asymmetric brushes and an adjacent, but independent, vacuum assembly such that the cleaning capability and efficiency of the self-adjustable cleaning head subsystem is optimized while concomitantly minimizing the power requirements thereof. The autonomous floor-cleaning robot further includes a side brush assembly for directing particulates outside the envelope of the robot into the self-adjustable cleaning head subsystem.

(2) Description of Related Art

Autonomous robot cleaning devices are known in the art. For example, U.S. Pat. Nos. 5,940,927 and 5,781,960 disclose an Autonomous Surface Cleaning Apparatus and a Nozzle Arrangement for a Self-Guiding Vacuum Cleaner. One of the primary requirements for an autonomous cleaning device is a self-contained power supply—the utility of an autonomous cleaning device would be severely degraded, if not outright eliminated, if such an autonomous cleaning device utilized a power cord to tap into an external power source.

And, while there have been distinct improvements in the energizing capabilities of self-contained power supplies such as batteries, today's self-contained power supplies are still time-limited in providing power. Cleaning mechanisms for cleaning devices such as brush assemblies and vacuum assemblies typically require large power loads to provide effective cleaning capability. This is particularly true where brush assemblies and vacuum assemblies are configured as combinations, since the brush assembly and/or the vacuum assembly of such combinations typically have not been designed or configured for synergic operation.

A need exists to provide an autonomous cleaning device that has been designed and configured to optimize the cleaning capability and efficiency of its cleaning mechanisms for synergic operation while concomitantly minimizing or reducing the power requirements of such cleaning mechanisms.

SUMMARY OF THE INVENTION

One object of the present invention is to provide a cleaning device that is operable without human intervention to clean designated areas.

Another object of the present invention is to provide such an autonomous cleaning device that is designed and configured to optimize the cleaning capability and efficiency of its cleaning mechanisms for synergic operations while concomitantly minimizing the power requirements of such mechanisms.

These and other objects of the present invention are provided by one embodiment autonomous floor-cleaning robot according to the present invention that comprises a housing infrastructure including a chassis, a power subsystem; for providing the energy to power the autonomous floor-cleaning robot, a motive subsystem operative to propel the autonomous floor-cleaning robot for cleaning operations, a control module operative to control the autonomous floor-cleaning robot to effect cleaning operations, and a self-adjusting cleaning head subsystem that includes a deck mounted in pivotal combination with the chassis, a brush assembly mounted in combination with the deck and powered by the motive subsystem to sweep up particulates during cleaning operations, a vacuum assembly disposed in combination with the deck and powered by the motive subsystem to ingest particulates during cleaning operations, and a deck height adjusting subassembly mounted in combination with the motive subsystem for the brush assembly, the deck, and the chassis that is automatically operative in response to a change in torque in said brush assembly to pivot the deck with respect to said chassis and thereby adjust the height of the brushes from the floor. The autonomous floor-cleaning robot also includes a side brush assembly mounted in combination with the chassis and powered by the motive subsystem to entrain particulates outside the periphery of the housing infrastructure and to direct such particulates towards the self-adjusting cleaning head subsystem.

BRIEF DESCRIPTION OF THE DRAWINGS

A more complete understanding of the present invention and the attendant features and advantages thereof may be had by reference to the following detailed description of the invention when considered in conjunction with the accompanying drawings wherein.

DETAILED DESCRIPTION OF THE INVENTION

Figure 1:
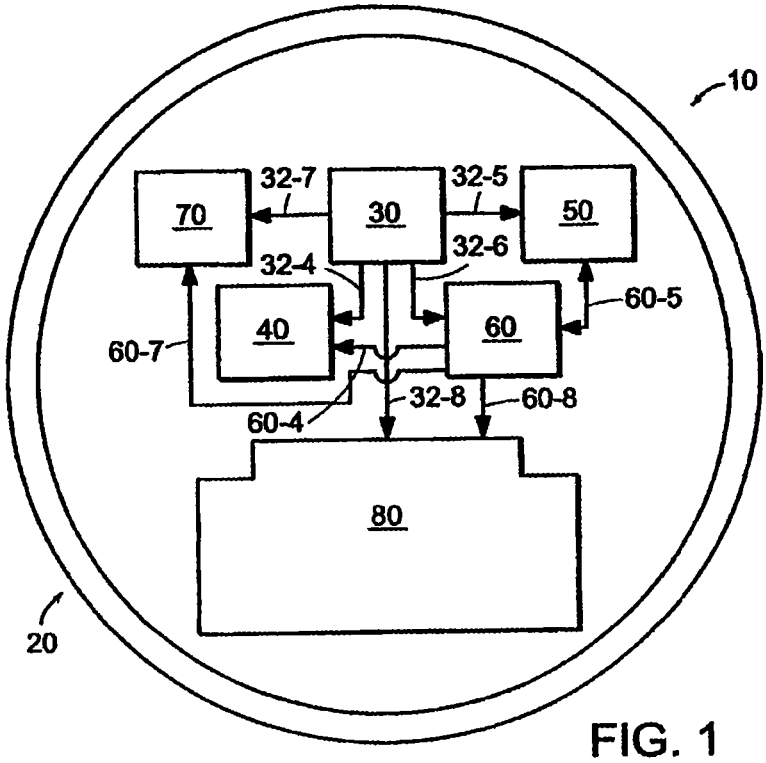
FIG. 1 is a schematic representation of an autonomous floor-cleaning robot according to the present invention.
Figure 2:
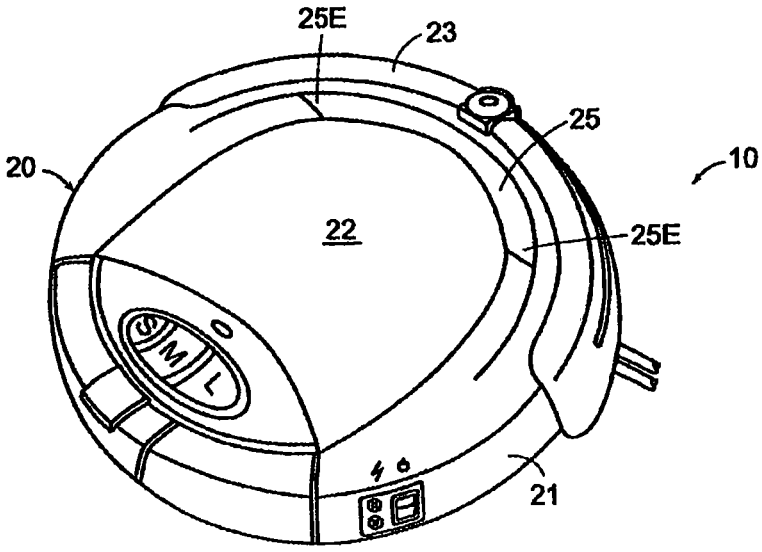
FIG. 2 is a perspective view of one embodiment of an autonomous floor-cleaning robot according to the present invention.
Figure 2A:
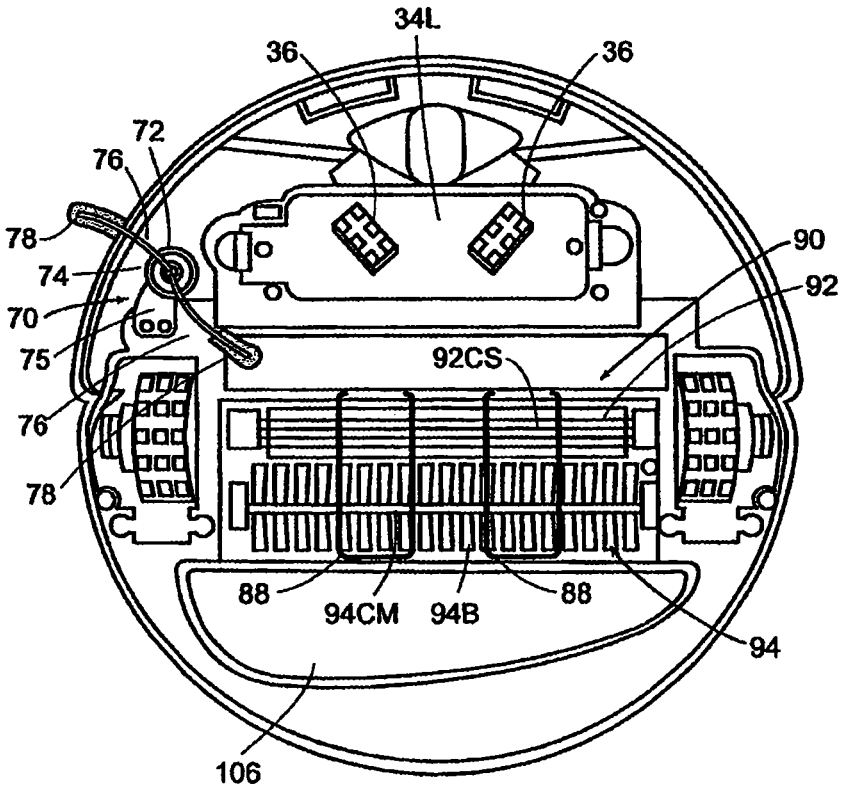
FIG. 2A is a bottom plan view of the autonomous floor-cleaning robot of FIG. 2.

Referring now to the drawings where like reference numerals identify corresponding or similar elements throughout the several views, FIG. 1 is a schematic representation of an autonomous floor-cleaning robot 10 according to the present invention. The robot 10 comprises a housing infrastructure 20, a power subsystem 30, a motive subsystem 40, a sensor subsystem 50, a control module 60, a side brush assembly 70, and a self-adjusting cleaning head subsystem 80. The power subsystem 30, the motive subsystem 40, the sensor subsystem 50, the control module 60, the side brush assembly 70, and the self-adjusting cleaning head subsystem 80 are integrated in combination with the housing infrastructure 20 of the robot 10 as described in further detail in the following paragraphs.

In the following description of the autonomous floor-cleaning robot 10, use of the terminology "forward/fore" refers to the primary direction of motion of the autonomous floor-cleaning robot 10, and the terminology fore-aft axis (see reference characters "FA" in FIGS. 3A, 3B) defines the forward direction of motion (indicated by arrowhead of the fore-aft axis FA), which is coincident with the fore-aft diameter of the robot 10.

Referring to FIGS. 2, 2A, and 3A-3C, the housing infrastructure 20 of the robot 10 comprises a chassis 21, a cover 22, a displaceable bumper 23, a nose wheel subassembly 24, and a carrying handle 25. The chassis 21 is preferably molded from a material such as plastic as a unitary element that includes a plurality of preformed wells, recesses, and structural members for, inter alia, mounting or integrating elements of the power subsystem 30, the motive subsystem 40, the sensor subsystem 50, the side brush assembly 70, and the self-adjusting cleaning head subsystem 80 in combination with the chassis 21. The cover 22 is preferably molded from a material such as plastic as a unitary element that is complementary in configuration with the chassis 21 and provides protection of and access to elements/components mounted to the chassis 21 and/or comprising the self-adjusting cleaning head subsystem 80. The chassis 21 and the cover 22 are detachably integrated in combination by any suitable means, e.g., screws, and in combination, the chassis 21 and cover 22 form a structural envelope of minimal height having a generally cylindrical configuration that is generally symmetrical along the fore-aft axis FA.

The displaceable bumper 23, which has a generally arcuate configuration, is mounted in movable combination at the forward portion of the chassis 21 to extend outwardly therefrom, i.e., the normal operating position. The mounting configuration of the displaceable bumper is such that the bumper 23 is displaced towards the chassis 21 (from the normal operating position) whenever the bumper 23 encounters a stationary object or obstacle of predetermined mass, i.e., the displaced position, and returns to the normal operating position when contact with the stationary object or obstacle is terminated (due to operation of the control module 60 which, in response to any such displacement of the bumper 23, implements a "bounce" mode that causes the robot 10 to evade the stationary object or obstacle and continue its cleaning routine, e.g., initiate a random—or weighted-random—turn to resume forward movement in a different direction). The mounting configuration of the displaceable bumper 23 comprises a pair of rotatable support members 23RSM, which are operative to facilitate the movement of the bumper 23 with respect to the chassis 21.

The pair of rotatable support members 23RSM are symmetrically mounted about the fore-aft axis FA of the autonomous floor-cleaning robot 10 proximal the center of the displaceable bumper 23 in a V-configuration. One end of each support member 23RSM is rotatably mounted to the chassis 21 by conventional means, e.g., pins/dowel and sleeve arrangement, and the other end of each support member 23RSM is likewise rotatably mounted to the displaceable bumper 23 by similar conventional means. A biasing spring (not shown) is disposed in combination with each rotatable support member 23RSM and is operative to provide the biasing force necessary to return the displaceable bumper 23 (through rotational movement of the support members 23RSM) to the normal operating position whenever contact with a stationary object or obstacle is terminated.

The embodiment described herein includes a pair of bumper arms 23BA that are symmetrically mounted in parallel about the fore-aft diameter FA of the autonomous floor-cleaning robot 10 distal the center of the displaceable bumper 23. These bumper arms 23BA do not per se provide structural support for the displaceable bumper 23, but rather are a part of the sensor subsystem 50 that is operative to determine the location of a stationary object or obstacle encountered via the bumper 23. One end of each bumper arm 23BA is rigidly secured to the displaceable bumper 23 and the other end of each bumper arm 23BA is mounted in combination with the chassis 21 in a manner, e.g., a slot arrangement such that, during an encounter with a stationary object or obstacle, one or both bumper arms 23BA are linearly displaceable with respect to the chassis 21 to activate an associated sensor, e.g., IR break beam sensor, mechanical switch, capacitive sensor, which provides a corresponding signal to the control module 60 to implement the "bounce" mode. Further details regarding the operation of this aspect of the sensor subsystem 50, as well as alternative embodiments of sensors having utility in detecting contact with or proximity to stationary objects or obstacles can be found in commonly-owned, co-pending U.S. patent application Ser. No. 10/056,804, filed 24 Jan. 2002, entitled Method and System for Multi-Mode Coverage for an Autonomous Robot.

The nose-wheel subassembly 24 comprises a wheel 24W rotatably mounted in combination with a clevis member 24CM that includes a mounting shaft. The clevis mounting shaft 24CM is disposed in a well in the chassis 21 at the forward end thereof on the fore-aft diameter of the autonomous floor-cleaning robot 10. A biasing spring 24BS (hidden behind a leg of the clevis member 24CM in FIG. 3C) is disposed in combination with the clevis mounting shaft 24CM and operative to bias the nose-wheel subassembly 24 to an 'extended' position whenever the nose-wheel subassembly 24 loses contact with the surface to be cleaned. During cleaning operations, the weight of the autonomous floor-cleaning robot 10 is sufficient to overcome the force exerted by the biasing spring 24BS to bias the nose-wheel subassembly 24 to a partially retracted or operating position wherein the wheel rotates freely over the surface to be cleaned.

Opposed triangular or conical wings 24TW extend outwardly from the ends of the clevis member to prevent the side of the wheel from catching on low obstacle during turning movements of the autonomous floor-cleaning robot 10. The wings 24TW act as ramps in sliding over bumps as the robot turns.

Ends 25E of the carrying handle 25 are secured in pivotal combination with the cover 22 at the forward end thereof, centered about the fore-aft axis FA of the autonomous floor-cleaning robot 10. With the autonomous floor-cleaning robot 10 resting on or moving over a surface to be cleaned, the carrying handle 25 lies approximately flush with the surface of the cover 22 (the weight of the carrying handle 25, in conjunction with arrangement of the handle-cover pivot configuration, is sufficient to automatically return the carrying handle 25 to this flush position due to gravitational effects). When the autonomous floor-cleaning robot 10 is picked up by means of the carrying handle 25, the aft end of the autonomous floor-cleaning robot 10 lies below the forward end of the autonomous floor-cleaning robot 10 so that particulate debris is not dislodged from the self-adjusting cleaning head subsystem 80.

The power subsystem 30 of the described embodiment provides the energy to power individual elements/components of the motive subsystem 40, the sensor subsystem 50, the side brush assembly 70, and the self-adjusting cleaning head subsystem 80 and the circuits and components of the control module 60 via associated circuitry 32-4, 32-5, 32-7, 32-8, and 32-6, respectively (see FIG. 1) during cleaning operations. The power subsystem 30 for the described embodiment of the autonomous floor-cleaning robot 10 comprises a rechargeable battery pack 34 such as a NiMH battery pack. The rechargeable battery pack 34 is mounted in a well formed in the chassis 21 (sized specifically for mounting/retention of the battery pack 34) and retained therein by any conventional means, e.g., spring latches (not shown). The battery well is covered by a lid 34L secured to the chassis 21 by conventional means such as screws. Affixed to the lid 34L are friction pads 36 that facilitate stopping of the autonomous floor-cleaning robot 10 during automatic shutdown. The friction pads 36 aid in stopping the robot upon the robot's attempting to drive over a cliff. The rechargeable battery pack 34 is configured to provide sufficient power to run the autonomous floor-cleaning robot 10 for a period of sixty (60) to ninety (90) minutes on a full charge while meeting the power requirements of the elements/components comprising motive subsystem 40, the sensor subsystem 50, the side brush assembly 70, the self-adjusting cleaning head subsystem 80, and the circuits and components of the control module 60.

The motive subsystem 40 comprises the independent means that: (1) propel the autonomous floor-cleaning robot 10 for cleaning operations; (2) operate the side brush assembly 70; and (3) operate the self-adjusting cleaning head subsystem 80 during such cleaning operations. Such independent means includes right and left main wheel subassemblies 42A, 42B, each subassembly 42A, 42B having its own independently-operated motor $\mathbf{42}A_M$, $\mathbf{42}B_M$, respectively, an independent electric motor 44 for the side brush assembly 70, and two independent electric motors 46, 48 for the self-adjusting brush subsystem 80, one motor 46 for the vacuum assembly and one motor 48 for the dual-stage brush assembly.

The right and left main wheel subassemblies 42A, 42B are independently mounted in wells of the chassis 21 formed at opposed ends of the transverse diameter of the chassis 21 (the transverse diameter is perpendicular to the fore-aft axis FA of the robot 10). Mounting at this location provides the autonomous floor-cleaning robot 10 with an enhanced turning capability, since the main wheel subassemblies 42A, 42B motor can be independently operated to effect a wide range of turning maneuvers, e.g., sharp turns, gradual turns, turns in place.

Each main wheel subassembly 42A, 42B comprises a wheel $\mathbf{42}A_W$, $\mathbf{42}B_W$ rotatably mounted in combination with a clevis member $\mathbf{42}A_{CM}$, $\mathbf{42}B_{CM}$. Each clevis member $\mathbf{42}A_{CM}$, $\mathbf{42}B_{CM}$ is pivotally mounted to the chassis 21 aft of the wheel axis of rotation (see FIG. 3C which illustrates the wheel axis of rotation $\mathbf{42}A_{AR}$; the wheel axis of rotation for wheel subassembly 42B, which is not shown, is identical), i.e., independently suspended. The aft pivot axis $\mathbf{42}A_{PA}$, $\mathbf{42}B_{PA}$ (see FIG. 3A) of the main wheel subassemblies 42A, 42B facilitates the mobility of the autonomous floor-cleaning robot 10, i.e., pivotal movement of the subassemblies 42A, 42B through a predetermined arc. The motor $\mathbf{42}A_M$, $\mathbf{42}B_M$ associated with each main wheel subassembly 42A, 42B is mounted to the aft end of the clevis member $\mathbf{42}A_{CM}$, $\mathbf{42}B_{CM}$. One end of a tension spring $\mathbf{42}B_{TS}$ (the tension spring for the right wheel subassembly 42A is not illustrated, but is identical to the tension spring 42BTS of the left wheel subassembly 42A) is attached to the aft portion of the clevis member $\mathbf{42}B_{CM}$ and the other end of the tension spring $\mathbf{42}B_{TS}$ is attached to the chassis 21 forward of the respective wheel $\mathbf{42}A_W$, 42 $B_W$.

Each tension spring is operative to rotatably bias the respective main wheel subassembly 42A, 42B (via pivotal movement of the corresponding clevis member $\mathbf{42}A_{CM}$, $\mathbf{42}B_{CM}$ through the predetermined arc) to an 'extended' position when the autonomous floor-cleaning robot 10 is removed from the floor (in this 'extended' position the wheel axis of rotation lies below the bottom plane of the chassis 21). With the autonomous floor-cleaning robot 10 resting on or moving over a surface to be cleaned, the weight of autonomous floor-cleaning robot 10 gravitationally biases each main wheel subassembly 42A, 42B into a retracted or operating position wherein axis of rotation of the wheels are approximately coplanar with bottom plane of the chassis 21. The motors $\mathbf{42}A_M$, $\mathbf{42}B_M$ of the main wheel subassemblies 42A, 42B are operative to drive the main wheels: (1) at the same speed in the same direction of rotation to propel the autonomous floor-cleaning robot 10 in a straight line, either forward or aft; (2) at different speeds (including the situation wherein one wheel is operated at zero speed) to effect turning patterns for the autonomous floor-cleaning robot 10; or (3) at the same speed in opposite directions of rotation to cause the robot 10 to turn in place, i.e., "spin on a dime".

The wheels $\mathbf{42}A_W$, $\mathbf{42}B_W$ of the main wheel subassemblies 42A, 42B preferably have a "knobby" tread configuration $\mathbf{42}A_{KT}$, $\mathbf{42}B_{KT}$. This knobby tread configuration $\mathbf{42}A_{KT}$, $\mathbf{42}B_{KT}$ provides the autonomous floor-cleaning robot 10 with enhanced traction, particularly when traversing smooth surfaces and traversing between contiguous surfaces of different textures, e.g., bare floor to carpet or vice versa. This knobby tread configuration $\mathbf{42}A_{KT}$, $\mathbf{42}B_{KT}$ also prevents tufted fabric of carpets/rags from being entrapped in the wheels $\mathbf{42}A_W$, 42B and entrained between the wheels and the chassis 21 during movement of the autonomous floor-cleaning robot 10. One skilled in the art will appreciate, however, that other tread patterns/configurations are within the scope of the present invention.

The sensor subsystem 50 comprises a variety of different sensing units that may be broadly characterized as either: (1) control sensing units 52; or (2) emergency sensing units 54. As the names imply, control sensing units 52 are operative to regulate the normal operation of the autonomous floor-cleaning robot 10 and emergency sensing units 54 are operative to detect situations that could adversely affect the operation of the autonomous floor-cleaning robot 10 (e.g., stairs descending from the surface being cleaned) and provide signals in response to such detections so that the autonomous floor-cleaning robot 10 can implement an appropriate response via the control module 60. The control sensing units 52 and emergency sensing units 54 of the autonomous floor-cleaning robot 10 are summarily described in the following paragraphs; a more complete description can be found in commonly-owned, co-pending U.S. patent application Ser. Nos. 09/768,773, filed 24 Jan. 2001, entitled Robot Obstacle Detection System, 10/167,851, 12 Jun. 2002, entitled Method and System for Robot Localization and Confinement, and 10/056,804, filed 24 Jan. 2002, entitled Method and System for Multi-Mode Coverage for an Autonomous Robot.

The control sensing units 52 include obstacle detection sensors 52OD mounted in conjunction with the linearly-displaceable bumper arms 23BA of the displaceable bumper 23, a wall-sensing assembly 52WS mounted in the right-hand portion of the displaceable bumper 23, a virtual wall sensing assembly 52VWS mounted atop the displaceable bumper 23 along the fore-aft diameter of the autonomous floor-cleaning robot 10, and an IR sensor/encoder combination 52WE mounted in combination with each wheel subassembly 42A, 42B.

Each obstacle detection sensor 52OD includes an emitter and detector combination positioned in conjunction with one of the linearly displaceable bumper arms 23BA so that the sensor 52OD is operative in response to a displacement of the bumper arm 23BA to transmit a detection signal to the control module 60. The wall sensing assembly 52WS includes an emitter and detector combination that is operative to detect the proximity of a wall or other similar structure and transmit a detection signal to the control module 60. Each IR sensor/encoder combination 52WE is operative to measure the rotation of the associated wheel subassembly 42A, 42B and transmit a signal corresponding thereto to the control module 60.

The virtual wall sensing assembly 52VWS includes detectors that are operative to detect a force field and a collimated beam emitted by a stand-alone emitter (the virtual wall unit—not illustrated) and transmit respective signals to the control module 60. The autonomous floor cleaning robot 10 is programmed not to pass through the collimated beam so that the virtual wall unit can be used to prevent the robot 10 from entering prohibited areas, e.g., access to a descending staircase, room not to be cleaned. The robot 10 is further programmed to avoid the force field emitted by the virtual wall unit, thereby preventing the robot 10 from overrunning the virtual wall unit during floor cleaning operations.

The emergency sensing units 54 include 'cliff detector' assemblies 54CD mounted in the displaceable bumper 23, wheeldrop assemblies 54WD mounted in conjunction with the left and right main wheel subassemblies 42A, 42B and the nose-wheel assembly 24, and current stall sensing units 54CS for the motor $\mathbf{42}A_M$, $\mathbf{42}B_M$ of each main wheel subassembly 42A, 42B and one for the motors 44, 48 (these two motors are powered via a common circuit in the described embodiment). For the described embodiment of the autonomous floor-cleaning robot 10, four (4) cliff detector assemblies 54CD are mounted in the displaceable bumper 23. Each cliff detector assembly 54CD includes an emitter and detector combination that is operative to detect a predetermined drop in the path of the robot 10, e.g., descending stairs, and transmit a signal to the control module 60. The wheeldrop assemblies 54WD are operative to detect when the corresponding left and right main wheel subassemblies 32A, 32B and/or the nose-wheel assembly 24 enter the extended position, e.g., a contact switch, and to transmit a corresponding signal to the control module 60. The current stall sensing units 54CS are operative to detect a change in the current in the respective motor, which indicates a stalled condition of the motor's corresponding components, and transmit a corresponding signal to the control module 60.

The control module 60 comprises the control circuitry (see, e.g., control lines 60-4, 60-5, 60-7, and 60-8 in FIG. 1) and microcontroller for the autonomous floor-cleaning robot 10 that controls the movement of the robot 10 during floor cleaning operations and in response to signals generated by the sensor subsystem 50. The control module 60 of the autonomous floor-cleaning robot 10 according to the present invention is preprogrammed (hardwired, software, firmware, or combinations thereof) to implement three basic operational modes, i.e., movement patterns, that can be categorized as: (1) a "spot-coverage" mode; (2) a "wall/obstacle following" mode; and (3) a "bounce" mode. In addition, the control module 60 is preprogrammed to initiate actions based upon signals received from sensor subsystem 50, where such actions include, but are not limited to, implementing movement patterns (2) and (3), an emergency stop of the robot 10, or issuing an audible alert. Further details regarding the operation of the robot 10 via the control module 60 are described in detail in commonly-owned, co-pending U.S. patent application Ser. Nos. 09/768,773, filed 24 Jan. 2001, entitled Robot Obstacle Detection System, 10/167,851, filed 12 Jun. 2002, entitled Method and System for Robot Localization and Confinement, and 10/056,804, filed 24 Jan. 2002, entitled Method and System for Multi-Mode Coverage for an Autonomous Robot.

The side brush assembly 70 is operative to entrain macroscopic and microscopic particulates outside the periphery of the housing infrastructure 20 of the autonomous floor-cleaning robot 10 and to direct such particulates towards the self-adjusting cleaning head subsystem 80. This provides the robot 10 with the capability of cleaning surfaces adjacent to baseboards (during the wall-following mode).

The side brush assembly 70 is mounted in a recess formed in the lower surface of the right forward quadrant of the chassis 21 (forward of the right main wheel subassembly 42A just behind the right hand end of the displaceable bumper 23). The side brush assembly 70 comprises a shaft 72 having one end rotatably connected to the electric motor 44 for torque transfer, a hub 74 connected to the other end of the shaft 72, a cover plate 75 surrounding the hub 74, a brush means 76 affixed to the hub 74, and a set of bristles 78.

The cover plate 75 is configured and secured to the chassis 21 to encompass the hub 74 in a manner that prevents the brush means 76 from becoming stuck under the chassis 21 during floor cleaning operations.

Figure 3A:
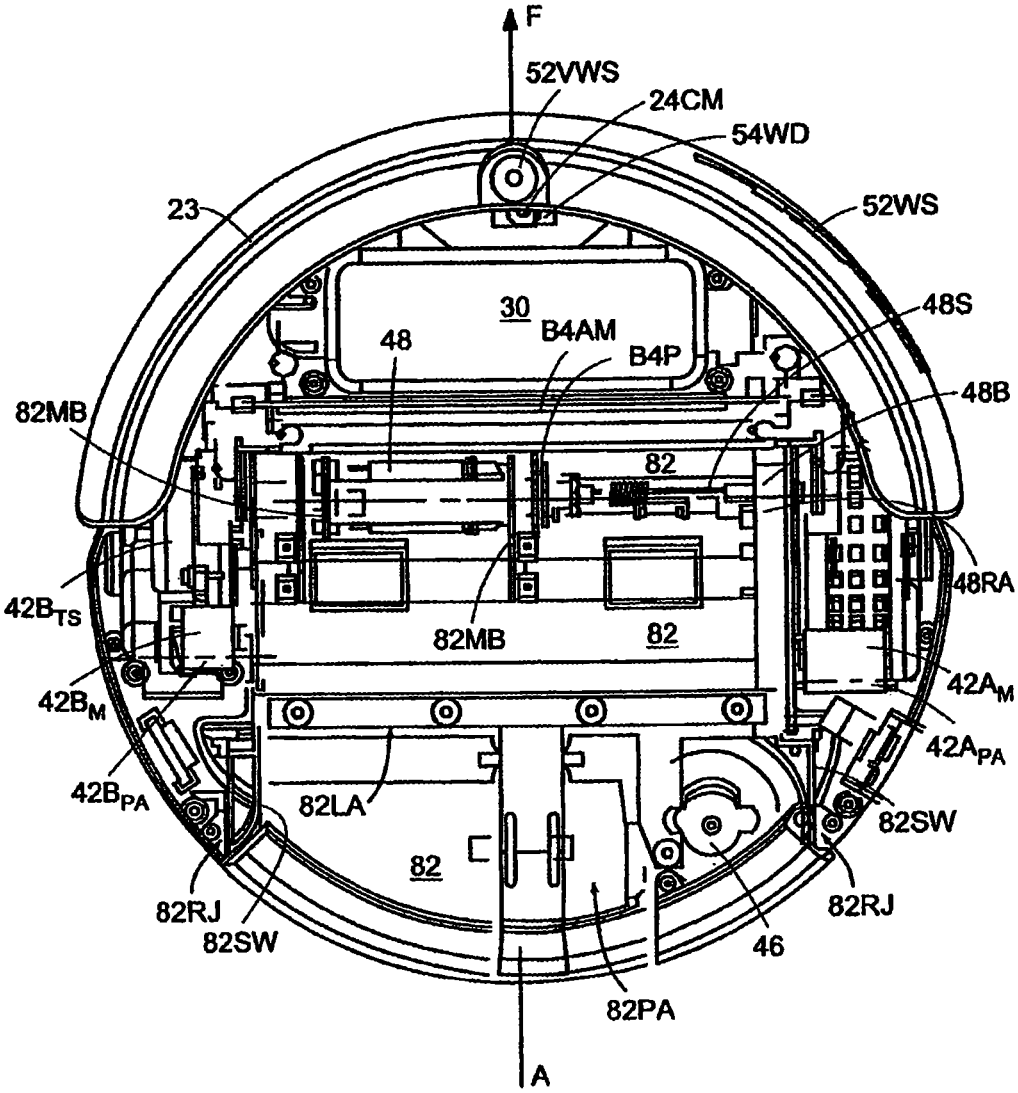
FIG. 3A is a top, partially-sectioned plan view, with cover removed, of another embodiment of an autonomous floor-cleaning robot according to the present invention.
Figure 3B:
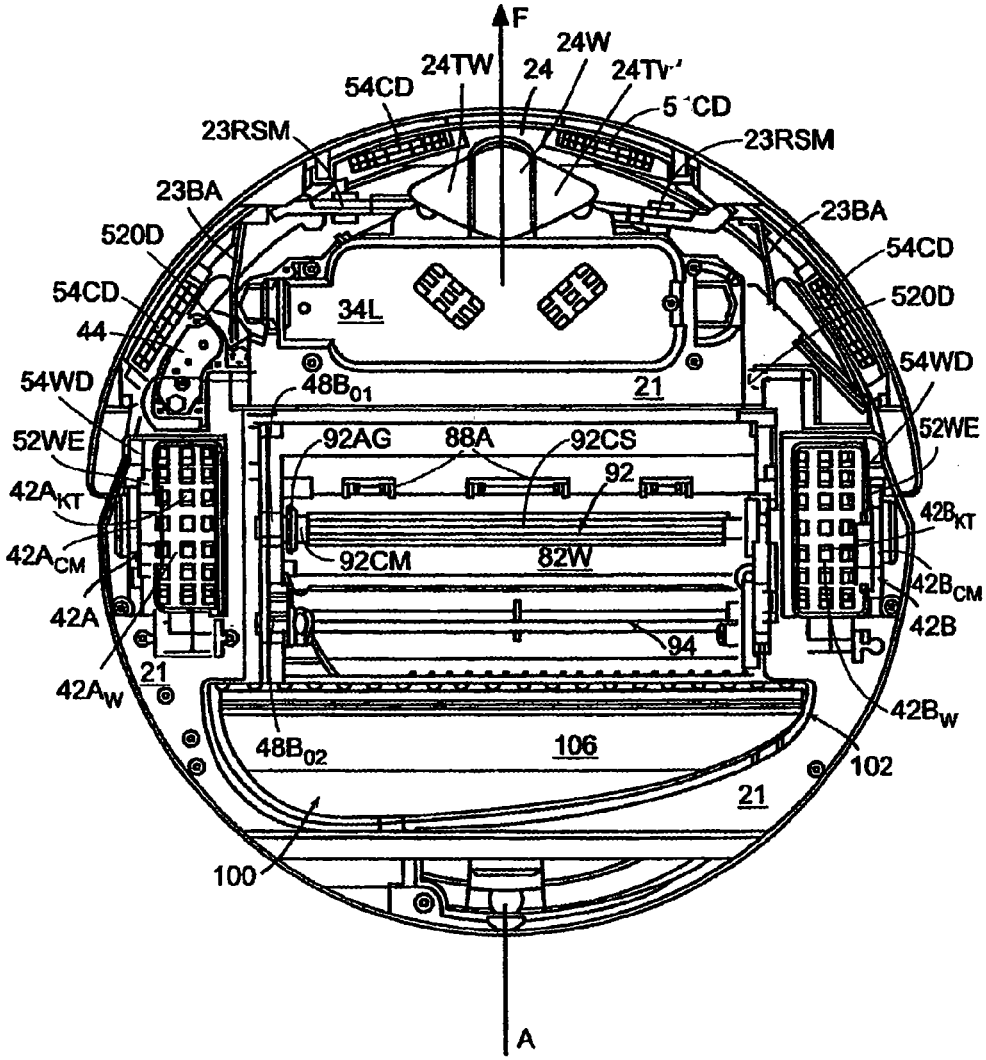
FIG. 3B is a bottom, partially-section plan view of the autonomous floor-cleaning robot embodiment of FIG. 3A.
Figure 3C:
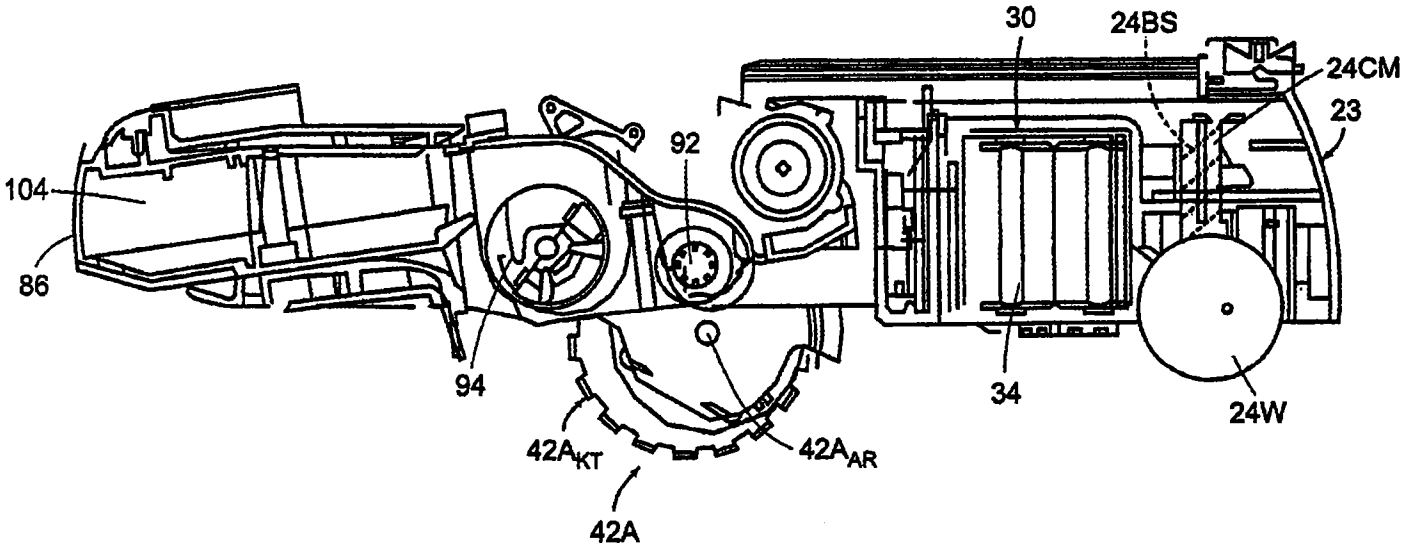
FIG. 3C is a side, partially sectioned plan view of the autonomous floor-cleaning robot embodiment of FIG. 3A.

For the embodiment of FIGS. 3A-3C, the brush means 76 comprises opposed brush arms that extend outwardly from the hub 74. These brush arms 76 are formed from a compliant plastic or rubber material in an "L"/hockey stick configuration of constant width. The configuration and composition of the brush arms 76, in combination, allows the brush arms 76 to resiliently deform if an obstacle or obstruction is temporarily encountered during cleaning operations. Concomitantly, the use of opposed brush arms 76 of constant width is a trade-off (versus using a full or partial circular brush configuration) that ensures that the operation of the brush means 76 of the side brush assembly 70 does not adversely impact (i.e., by occlusion) the operation of the adjacent cliff detector subassembly 54CD (the left-most cliff detector subassembly 54CD in FIG. 3B) in the displaceable bumper 23. The brush arms 76 have sufficient length to extend beyond the outer periphery of the autonomous floor-cleaning robot 10, in particular the displaceable bumper 23 thereof. Such a length allows the autonomous floor-cleaning robot 10 to clean surfaces adjacent to baseboards (during the wall-following mode) without scrapping of the wall/baseboard by the chassis 21 and/or displaceable bumper 23 of the robot 10.

The set of bristles 78 is set in the outermost free end of each brush arm 76 (similar to a toothbrush configuration) to provide the sweeping capability of the side brush assembly 70. The bristles 78 have a length sufficient to engage the surface being cleaned with the main wheel subassemblies 42A, 42B and the nose-wheel subassembly 24 in the operating position.

The self-adjusting cleaning head subsystem 80 provides the cleaning mechanisms for the autonomous floor-cleaning robot 10 according to the present invention. The cleaning mechanisms for the preferred embodiment of the self-adjusting cleaning head subsystem 80 include a brush assembly 90 and a vacuum assembly 100.

For the described embodiment of FIGS. 3A-3C, the brush assembly 90 is a dual-stage brush mechanism, and this dual-stage brush assembly 90 and the vacuum assembly 100 are independent cleaning mechanisms, both structurally and functionally, that have been adapted and designed for use in the robot 10 to minimize the over-all power requirements of the robot 10 while simultaneously providing an effective cleaning capability. In addition to the cleaning mechanisms described in the preceding paragraph, the self-adjusting cleaning subsystem 80 includes a deck structure 82 pivotally coupled to the chassis 21, an automatic deck adjusting subassembly 84, a removable dust cartridge 86, and one or more bails 88 shielding the dual-stage brush assembly 90.

The deck 82 is preferably fabricated as a unitary structure from a material such as plastic and includes opposed, spaced-apart sidewalls 82SW formed at the aft end of the deck 82 (one of the sidewalls 82SW comprising a U-shaped structure that houses the motor 46, a brush-assembly well 82W, a lateral aperture 82LA formed in the intermediate portion of the lower deck surface, which defines the opening between the dual-stage brush assembly 90 and the removable dust cartridge 86, and mounting brackets 82MB formed in the forward portion of the upper deck surface for the motor 48.

The sidewalls 82SW are positioned and configured for mounting the deck 82 in pivotal combination with the chassis 21 by a conventional means, e.g., a revolute joint (see reference characters 82RJ in FIG. 3A). The pivotal axis of the deck 82-chassis 21 combination is perpendicular to the fore-aft axis FA of the autonomous floor-cleaning robot 10 at the aft end of the robot 10 (see reference character $\mathbf{82}_{PA}$ which identifies the pivotal axis in FIG. 3A).

The mounting brackets 82MB are positioned and configured for mounting the constant-torque motor 48 at the forward lip of the deck 82. The rotational axis of the mounted motor 48 is perpendicular to the fore-aft diameter of the autonomous floor-cleaning robot 10 (see reference character 48RA which identifies the rotational axis of the motor 48 in FIG. 3A). Extending from the mounted motor 48 is an shaft 48S for transferring the constant torque to the input side of a stationary, conventional dual-output gearbox 48B (the housing of the dual-output gearbox 48B is fabricated as part of the deck 82).

Figure 4A:
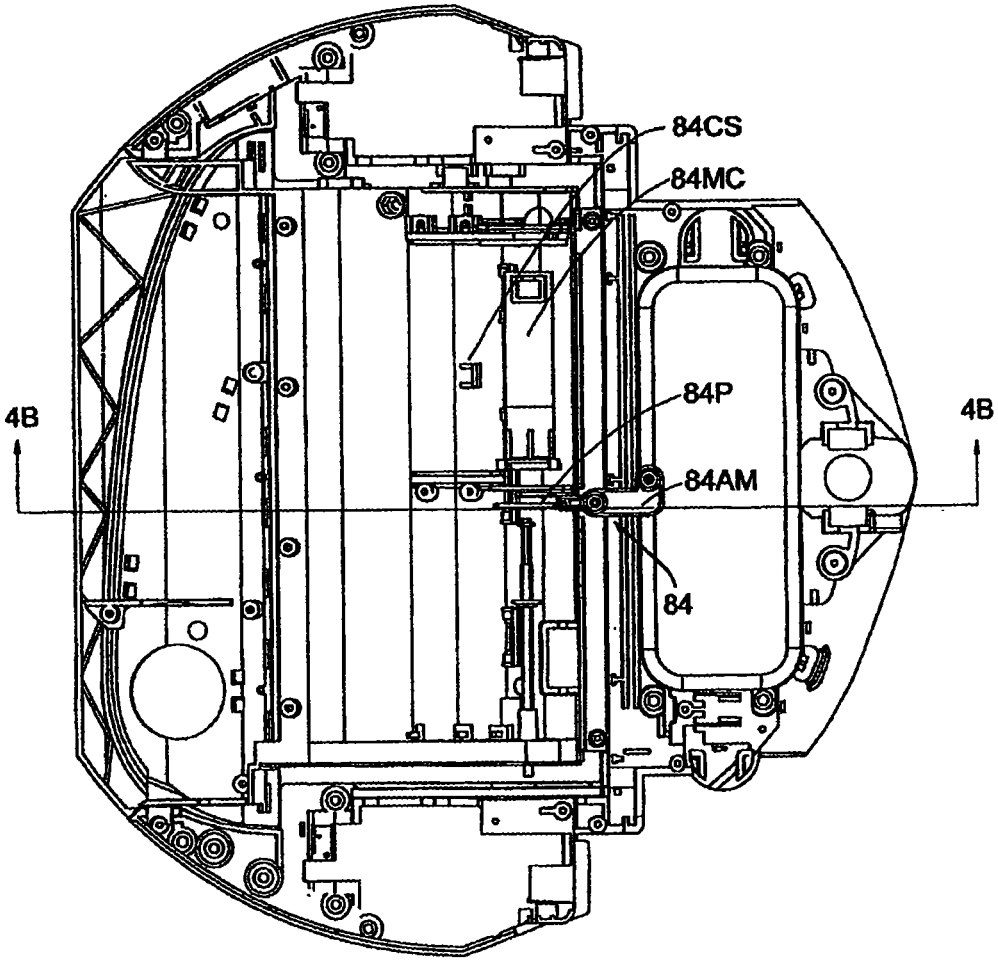
FIG. 4A is a top plan view of the deck and chassis of the autonomous floor-cleaning robot embodiment of FIG. 3A.
Figure 4B:
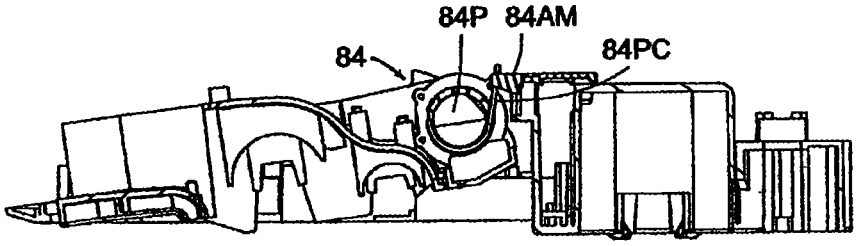
FIG. 4B is a cross-sectional view of FIG. 4A taken along line B-B thereof.
Figure 4C:
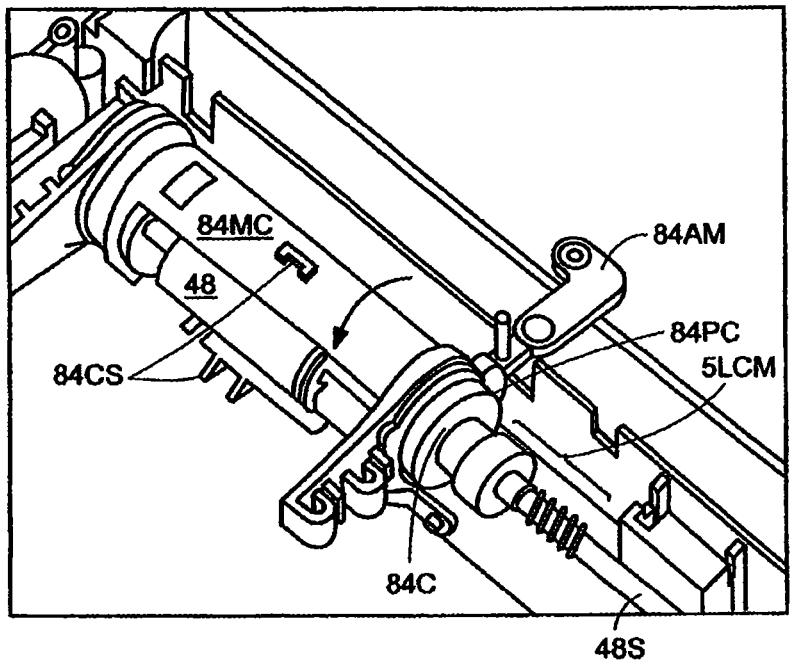
FIG. 4C is a perspective view of the deck-adjusting subassembly of autonomous floor-cleaning robot embodiment of FIG. 3A.

The desk adjusting subassembly 84, which is illustrated in further detail in FIGS. 4A-4C, is mounted in combination with the motor 48, the deck 82 and the chassis 21 and operative, in combination with the electric motor 48, to provide the physical mechanism and motive force, respectively, to pivot the deck 82 with respect to the chassis 21 about pivotal axis $\mathbf{82}_{PA}$ whenever the dual-stage brush assembly 90 encounters a situation that results in a predetermined reduction in the rotational speed of the dual-stage brush assembly 90. This situation, which most commonly occurs as the autonomous floor-cleaning robot 10 transitions between a smooth surface such as a floor and a carpeted surface, is characterized as the 'adjustment mode' in the remainder of this description.

The deck adjusting subassembly 84 for the described embodiment of FIG. 3A includes a motor cage 84MC, a pulley 84P, a pulley cord 84C, an anchor member 84AM, and complementary cage stops 84CS. The motor 48 is non-rotatably secured within the motor cage 84MC and the motor cage 84MC is mounted in rotatable combination between the mounting brackets 82MB. The pulley 84P is fixedly secured to the motor cage 84MC on the opposite side of the interior mounting bracket 82MB in such a manner that the shaft 48S of the motor 48 passes freely through the center of the pulley 84P. The anchor member 84AM is fixedly secured to the top surface of the chassis 21 in alignment with the pulley 84P.

One end of the pulley cord 84C is secured to the anchor member 84AM and the other end is secured to the pulley 84P in such a manner, that with the deck 82 in the 'down' or non-pivoted position, the pulley cord 84C is tensioned. One of the cage stops 84CS is affixed to the motor cage 84MC; the complementary cage stop 84CS is affixed to the deck 82. The complementary cage stops 84CS are in abutting engagement when the deck 82 is in the 'down' position during normal cleaning operations due to the weight of the self-adjusting cleaning head subsystem 80.

During normal cleaning operations, the torque generated by the motor 48 is transferred to the dual-stage brush subassembly 90 by means of the shaft 48S through the dual-output gearbox 48B. The motor cage assembly is prevented from rotating by the counter-acting torque generated by the pulley cord 84C on the pulley 84P. When the resistance encountered by the rotating brushes changes, the deck height will be adjusted to compensate for it. If for example, the brush torque increases as the machine rolls from a smooth floor onto a carpet, the torque output of the motor 48 will increase. In response to this, the output torque of the motor 48 will increase. This increased torque overcomes the counter-acting torque exerted by the pulley cord 84C on the pulley 84P. This causes the pulley 84P to rotate, effectively pulling itself up the pulley cord 84C. This in turn, pivots the deck about the pivot axis, raising the brushes, reducing the friction between the brushes and the floor, and reducing the torque required by the dual-stage brush subassembly 90. This continues until the torque between the motor 48 and the counter-acting torque generated by the pulley cord 84C on the pulley 84P are once again in equilibrium and a new deck height is established.

In other words, during the adjustment mode, the foregoing torque transfer mechanism is interrupted since the shaft 48S is essentially stationary. This condition causes the motor 48 to effectively rotate about the shaft 48S. Since the motor 48 is non-rotatably secured to the motor cage 84MC, the motor cage 84MC, and concomitantly, the pulley 84P, rotate with respect to the mounting brackets 82MB. The rotational motion imparted to the pulley 84P causes the pulley 84P to 'climb up' the pulley cord 84PC towards the anchor member 84AM. Since the motor cage 84MC is effectively mounted to the forward lip of the deck 82 by means of the mounting brackets 82MB, this movement of the pulley 84P causes the deck 82 to pivot about its pivot axis 82PA to an "up" position (see FIG. 4C). This pivoting motion causes the forward portion of the deck 82 to move away from surface over which the autonomous floor-cleaning robot is traversing.

Such pivotal movement, in turn, effectively moves the dual-stage brush assembly 90 away from the surface it was in contact with, thereby permitting the dual-stage brush assembly 90 to speed up and resume a steady-state rotational speed (consistent with the constant torque transferred from the motor 48). At this juncture (when the dual-stage brush assembly 90 reaches its steady-state rotational speed), the weight of the forward edge of the deck 82 (primarily the motor 48), gravitationally biases the deck 82 to pivot back to the 'down' or normal state, i.e., planar with the bottom surface of the chassis 21, wherein the complementary cage stops 84CS are in abutting engagement.

While the deck adjusting subassembly 84 described in the preceding paragraphs is the preferred pivoting mechanism for the autonomous floor-cleaning robot 10 according to the present invention, one skilled in the art will appreciate that other mechanisms can be employed to utilize the torque developed by the motor 48 to induce a pivotal movement of the deck 82 in the adjustment mode. For example, the deck adjusting subassembly could comprise a spring-loaded clutch mechanism such as that shown in FIG. 4C (identified by reference characters SLCM) to pivot the deck 82 to an "up" position during the adjustment mode, or a centrifugal clutch mechanism or a torque-limiting clutch mechanism. In other embodiments, motor torque can be used to adjust the height of the cleaning head by replacing the pulley with a cam and a constant force spring or by replacing the pulley with a rack and pinion, using either a spring or the weight of the cleaning head to generate the counter-acting torque.

The removable dust cartridge 86 provides temporary storage for macroscopic and microscopic particulates swept up by operation of the dual-stage brush assembly 90 and microscopic particulates drawn in by the operation of the vacuum assembly 100. The removable dust cartridge 86 is configured as a dual chambered structure, having a first storage chamber 86SC1 for the macroscopic and microscopic particulates swept up by the dual-stage brush assembly 90 and a second storage chamber 86SC2 for the microscopic particulates drawn in by the vacuum assembly 100. The removable dust cartridge 86 is further configured to be inserted in combination with the deck 82 so that a segment of the removable dust cartridge 86 defines part of the rear external sidewall structure of the autonomous floor-cleaning robot 10.

Figure 5A:
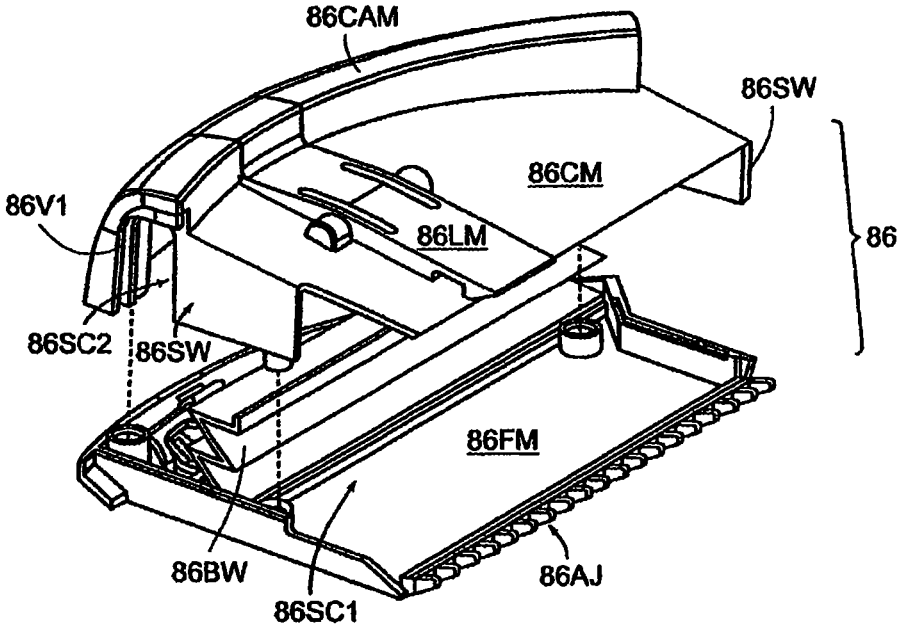
FIG. 5A is a first exploded perspective view of a dust cartridge for the autonomous floor-cleaning robot embodiment of FIG. 3A.
Figure 5B:
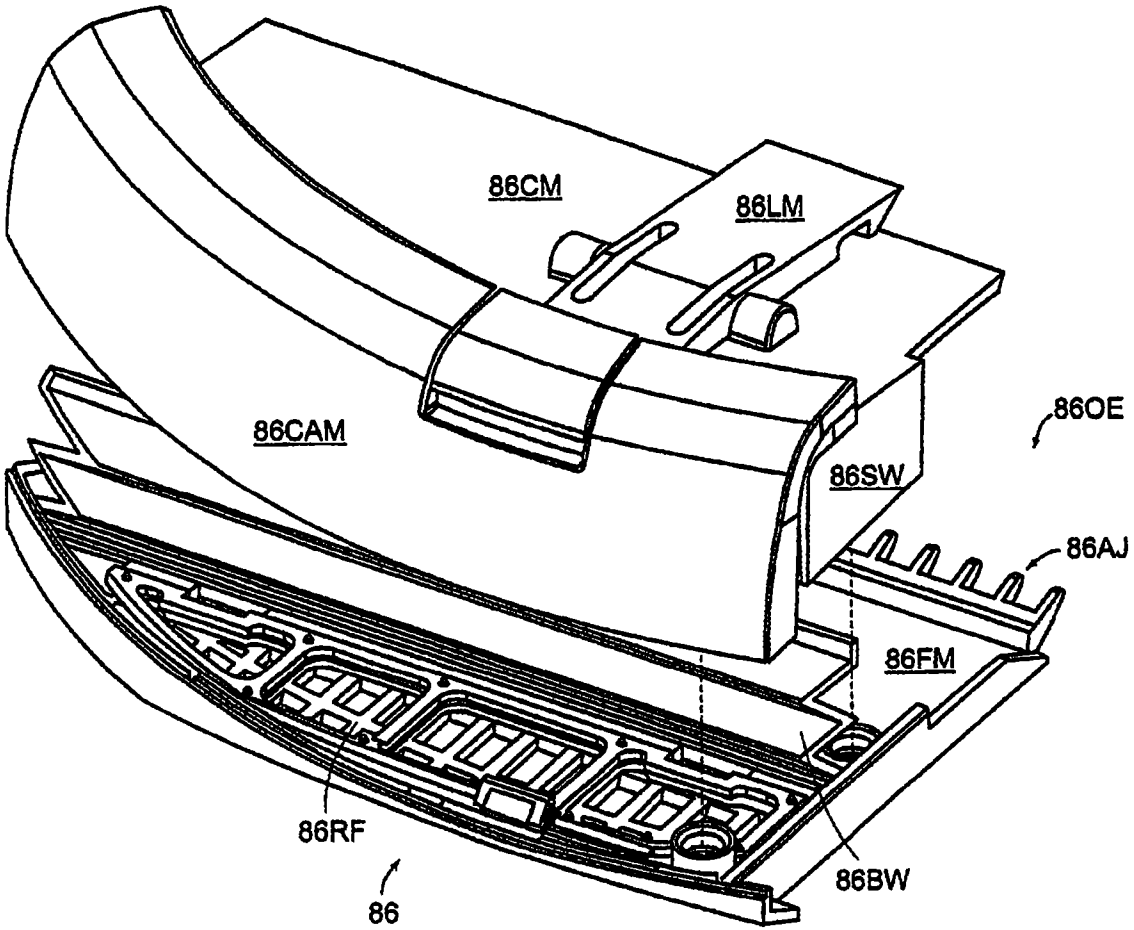
FIG. 5B is a second exploded perspective view of the dust cartridge of FIG. 5A.

As illustrated in FIGS. 5A-5B, the removable dust cartridge 86 comprises a floor member 86FM and a ceiling member 86CM joined together by opposed sidewall members 86SW. The floor member 86FM and the ceiling member 86CM extend beyond the sidewall members 86SW to define an open end 86OE, and the free end of the floor member 86FM is slightly angled and includes a plurality of baffled projections 86AJ to remove debris entrained in the brush mechanisms of the dual-stage brush assembly 90, and to facilitate insertion of the removable dust cartridge 86 in combination with the deck 82 as well as retention of particulates swept into the removable dust cartridge 86. A backwall member 86BW is mounted between the floor member 86FM and the ceiling member 86CM distal the open end 86OE in abutting engagement with the sidewall members 86SW. The backwall member 86BW has an baffled configuration for the purpose of deflecting particulates angularly therefrom to prevent particulates swept up by the dual-stage brush assembly 90 from ricocheting back into the brush assembly 90. The floor member 86FM, the ceiling member 86CM, the sidewall members 86SW, and the backwall member 86BW in combination define the first storage chamber 86SC1.

The removable dust cartridge 86 further comprises a curved arcuate member 86CAM that defines the rear external sidewall structure of the autonomous floor-cleaning robot 10. The curved arcuate member 86CAM engages the ceiling member 86CM, the floor member 86F and the sidewall members 86SW. There is a gap formed between the curved arcuate member 86CAM and one sidewall member 86SW that defines a vacuum inlet 86VI for the removable dust cartridge 86. A replaceable filter 86RF is configured for snap fit insertion in combination with the floor member 86FM. The replaceable filter 86RF, the curved arcuate member 86CAM, and the backwall member 86BW in combination define the second storage chamber 86SC1.

The removable dust cartridge 86 is configured to be inserted between the opposed spaced-apart sidewalls 82SW of the deck 82 so that the open end of the removable dust cartridge 86 aligns with the lateral aperture 82LA formed in the deck 82. Mounted to the outer surface of the ceiling member 86CM is a latch member 86LM, which is operative to engage a complementary shoulder formed in the upper surface of the deck 82 to latch the removable dust cartridge 86 in integrated combination with the deck 82.

The bail 88 comprises one or more narrow gauge wire structures that overlay the dual-stage brush assembly 90. For the described embodiment, the bail 88 comprises a continuous narrow gauge wire structure formed in a castellated configuration, i.e., alternating open-sided rectangles. Alternatively, the bail 88 may comprise a plurality of single, open-sided rectangles formed from narrow gauge wire. The bail 88 is designed and configured for press fit insertion into complementary retaining grooves 88A, 88B, respectively, formed in the deck 82 immediately adjacent both sides of the dual-stage brush assembly 90. The bail 88 is operative to shield the dual-stage brush assembly 90 from larger external objects such as carpet tassels, tufted fabric, rug edges, during cleaning operations, i.e., the bail 88 deflects such objects away from the dual-stage brush assembly 90, thereby preventing such objects from becoming entangled in the brush mechanisms.

Figure 6:
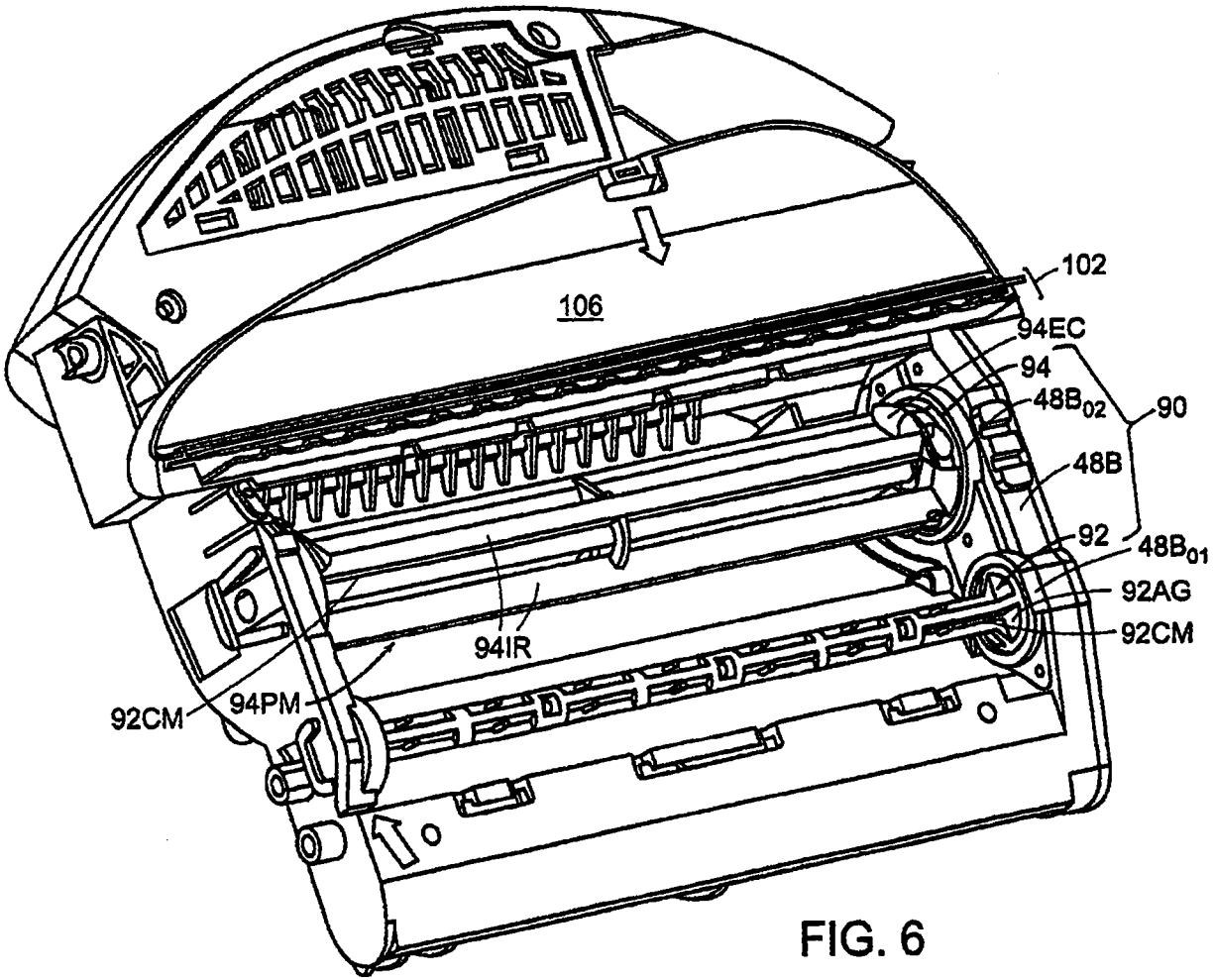
FIG. 6 is a perspective view of a dual-stage brush assembly including a flapper brush and a main brush for the autonomous floor-cleaning robot embodiment of FIG. 3A.

The dual-stage brush assembly 90 for the described embodiment of FIG. 3A comprises a flapper brush 92 and a main brush 94 that are generally illustrated in FIG. 6. Structurally, the flapper brush 92 and the main brush 94 are asymmetric with respect to one another, with the main brush 94 having an O.D. greater than the O.D. of the flapper brush 92. The flapper brush 92 and the main brush 94 are mounted in the deck 82 recess, as described below in further detail, to have minimal spacing between the sweeping peripheries defined by their respective rotating elements. Functionally, the flapper brush 92 and the main brush 94 counter-rotate with respect to one another, with the flapper brush 92 rotating in a first direction that causes macroscopic particulates to be directed into the removable dust cartridge 86 and the main brush 94 rotating in a second direction, which is opposite to the forward movement of the autonomous floor-cleaning robot 10, that causes macroscopic and microscopic particulates to be directed into the removable dust cartridge 86. In addition, this rotational motion of the main brush 94 has the secondary effect of directing macroscopic and microscopic particulates towards the pick-up zone of the vacuum assembly 100 such that particulates that are not swept up by the dual-stage brush assembly 90 can be subsequently drawn up (ingested) by the vacuum assembly 100 due to movement of the autonomous floor-cleaning robot 10.

The flapper brush 92 comprises a central member 92CM having first and second ends. The first and second ends are designed and configured to mount the flapper brush 92 in rotatable combination with the deck 82 and a first output port $48B_{O1}$ of the dual output gearbox 48B, respectively, such that rotation of the flapper brush 92 is provided by the torque transferred from the electric motor 48 (the gearbox 48B is configured so that the rotational speed of the flapper brush 92 is relative to the speed of the autonomous floor-cleaning robot 10—the described embodiment of the robot 10 has a top speed of approximately 0.9 ft/sec). In other embodiments, the flapper brush 92 rotates substantially faster than traverse speed either in relation or not in relation to the transverse speed. Axle guards 92AG having a beveled configuration are integrally formed adjacent the first and second ends of the central member 92CM for the purpose of forcing hair and other similar matter away from the flapper brush 92 to prevent such matter from becoming entangled with the ends of the central member 92CM and stalling the dual-stage brush assembly 90.

The brushing element of the flapper brush 92 comprises a plurality of segmented cleaning strips 92CS formed from a compliant plastic material secured to and extending along the central member 92CM between the internal ends of the axle guards 92AG (for the illustrated embodiment, a sleeve, configured to fit over and be secured to the central member 92CM, has integral segmented strips extending outwardly therefrom). It was determined that arranging these segmented cleaning strips 92CS in a herringbone or chevron pattern provided the optimal cleaning utility (capability and noise level) for the dual-stage brush subassembly 90 of the autonomous floor-cleaning robot 10 according to the present invention. Arranging the segmented cleaning strips 92CS in the herringbone/chevron pattern caused macroscopic particulate matter captured by the strips 92CS to be circulated to the center of the flapper brush 92 due to the rotation thereof. It was determined that cleaning strips arranged in a linear/straight pattern produced a irritating flapping noise as the brush was rotated. Cleaning strips arranged in a spiral pattern circulated captured macroscopic particulates towards the ends of brush, which resulted in particulates escaping the sweeping action provided by the rotating brush.

For the described embodiment, six (6) segmented cleaning strips 92CS were equidistantly spaced circumferentially about the central member 92CM in the herringbone/chevron pattern. One skilled in the art will appreciate that more or less segmented cleaning strips 92CS can be employed in the flapper brush 90 without departing from the scope of the present invention. Each of the cleaning strips 92S is segmented at prescribed intervals, such segmentation intervals depending upon the configuration (spacing) between the wire(s) forming the bail 88. The embodiment of the bail 88 described above resulted in each cleaning strip 92CS of the described embodiment of the flapper brush 92 having five (5) segments.

The main brush 94 comprises a central member 94CM (for the described embodiment the central member 94CM is a round metal member having a spiral configuration) having first and second straight ends (i.e., aligned along the centerline of the spiral). Integrated in combination with the central member 94CM is a segmented protective member 94PM. Each segment of the protective member 94PM includes opposed, spaced-apart, semi-circular end caps 94EC having integral ribs 94IR extending therebetween. For the described embodiment, each pair of semi-circular end caps EC has two integral ribs extending therebetween. The protective member 94PM is assembled by joining complementary semi-circular end caps 94EC by any conventional means, e.g., screws, such that assembled complementary end caps 94EC have a circular configuration.

The protective member 94PM is integrated in combination with the central member 94CM so that the central member 94CM is disposed along the centerline of the protective member 94PM, and with the first end of the central member 94CM terminating in one circular end cap 94EC and the second end of the central member 94CM extending through the other circular end cap 94EC. The second end of the central member 94CM is mounted in rotatable combination with the deck 82 and the circular end cap 94EC associated with the first end of the central member 94CM is designed and configured for mounting in rotatable combination with the second output port $\mathbf{48}B_{O2}$ of the gearbox 48B such that the rotation of the main brush 94 is provided by torque transferred from the electric motor 48 via the gearbox 48B.

Bristles 94B are set in combination with the central member 94CM to extend between the integral ribs 94IR of the protective member 94PM and beyond the O.D. established by the circular end caps 94EC. The integral ribs 94IR are configured and operative to impede the ingestion of matter such as rug tassels and tufted fabric by the main brush 94.

The bristles 94B of the main brush 94 can be fabricated from any of the materials conventionally used to form bristles for surface cleaning operations. The bristles 94B of the main brush 94 provide an enhanced sweeping capability by being specially configured to provide a "flicking" action with respect to particulates encountered during cleaning operations conducted by the autonomous floor-cleaning robot 10 according to the present invention. For the described embodiment, each bristle 94B has a diameter of approximately 0.010 inches, a length of approximately 0.90 inches, and a free end having a rounded configuration. It has been determined that this configuration provides the optimal flicking action. While bristles having diameters exceeding approximately 0.014 inches would have a longer wear life, such bristles are too stiff to provide a suitable flicking action in the context of the dual-stage brush assembly 90 of the present invention. Bristle diameters that are much less than 0.010 inches are subject to premature wear out of the free ends of such bristles, which would cause a degradation in the sweeping capability of the main brush. In a preferred embodiment, the main brush is set slightly lower than the flapper brush to ensure that the flapper does not contact hard surface floors.

The vacuum assembly 100 is independently powered by means of the electric motor 46. Operation of the vacuum assembly 100 independently of the self-adjustable brush assembly 90 allows a higher vacuum force to be generated and maintained using a battery-power source than would be possible if the vacuum assembly were operated in dependence with the brush system. In other embodiments, the main brush motor can drive the vacuum. Independent operation is used herein in the context that the inlet for the vacuum assembly 100 is an independent structural unit having dimensions that are not dependent upon the "sweep area" defined by the dual-stage brush assembly 90.

Figure 7A:
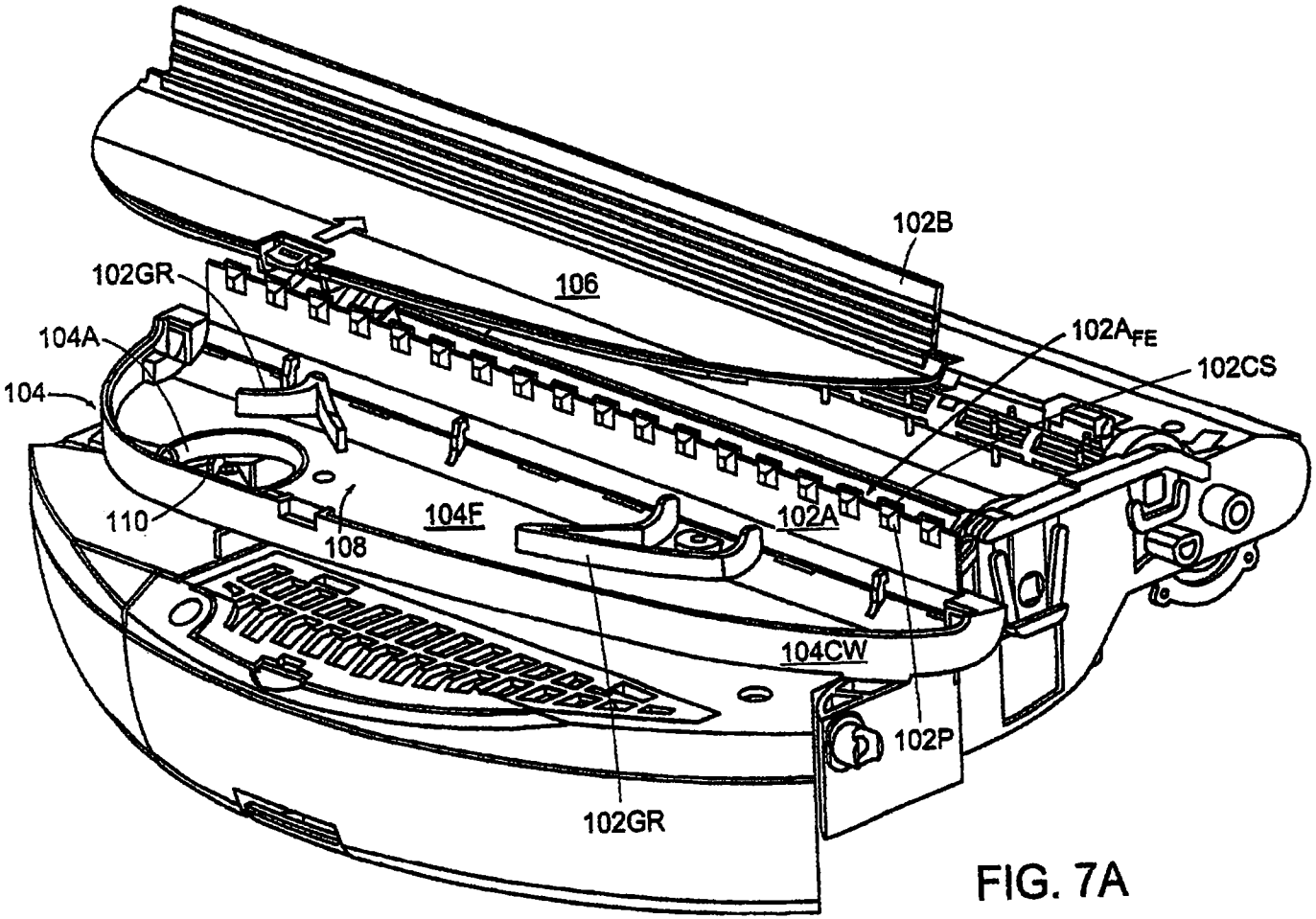
FIG. 7A is a perspective view illustrating the blades and vacuum compartment for the autonomous floor cleaning robot embodiment of FIG. 3A.
Figure 7B:
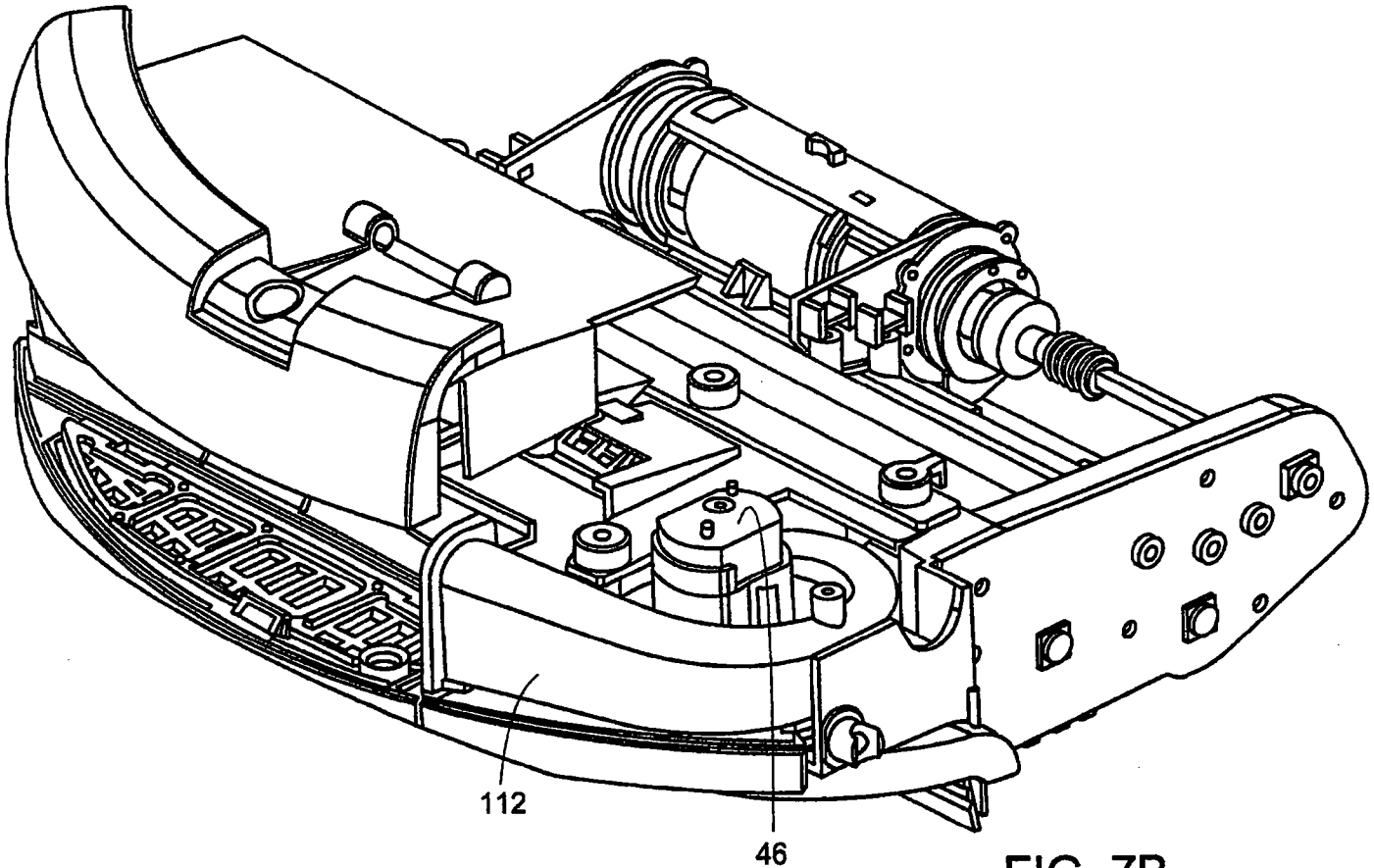
FIG. 7B is a partial perspective exploded view of the autonomous floor-cleaning robot embodiment of FIG. 7A.

The vacuum assembly 100, which is located immediately aft of the dual-stage brush assembly 90, i.e., a trailing edge vacuum, is orientated so that the vacuum inlet is immediately adjacent the main brush 94 of the dual-stage brush assembly 90 and forward facing, thereby enhancing the ingesting or vacuuming effectiveness of the vacuum assembly 100. With reference to FIGS. 7A, 7B, the vacuum assembly 100 comprises a vacuum inlet 102, a vacuum compartment 104, a compartment cover 106, a vacuum chamber 108, an impeller 110, and vacuum channel 112. The vacuum inlet 102 comprises first and second blades 102A, 102B formed of a semi-rigid/compliant plastic or elastomeric material, which are configured and arranged to provide a vacuum inlet 102 of constant size (lateral width and gap-see discussion below), thereby ensuring that the vacuum assembly 100 provides a constant air inflow velocity, which for the described embodiment is approximately 4 m/sec.

The first blade 102A has a generally rectangular configuration, with a width (lateral) dimension such that the opposed ends of the first blade 102A extend beyond the lateral dimension of the dual-stage brush assembly 90. One lateral edge of the first blade 102A is attached to the lower surface of the deck 82 immediately adjacent to but spaced apart from, the main brush 94 (a lateral ridge formed in the deck 82 provides the separation therebetween, in addition to embodying retaining grooves for the bail 88 as described above) in an orientation that is substantially symmetrical to the fore-aft diameter of the autonomous floor-cleaning robot 10. This lateral edge also extends into the vacuum compartment 104 where it is in sealed engagement with the forward edge of the compartment 104. The first blade 102A is angled forwardly with respect to the bottom surface of the deck 82 and has length such that the free end 102$A_{FE}$ of the first blade 102A just grazes the surface to be cleaned.

The free end 102$A_{FE}$ has a castellated configuration that prevents the vacuum inlet 102 from pushing particulates during cleaning operations. Aligned with the castellated segments 102CS of the free end 102$A_{FE}$, which are spaced along the width of the first blade 102A, are protrusions 102P having a predetermined height. For the prescribed embodiment, the height of such protrusions 102P is approximately 2 mm. The predetermined height of the protrusions 102P defines the "gap" between the first and second blades 102A, 102B.

The second blade 102B has a planar, unitary configuration that is complementary to the first blade 102A in width and length. The second blade 102B, however, does not have a castellated free end; instead, the free end of the second blade 102B is a straight edge. The second blade 102B is joined in sealed combination with the forward edge of the compartment cover 106 and angled with respect thereto so as to be substantially parallel to the first blade 102A. When the compartment cover 106 is fitted in position to the vacuum compartment 104, the planar surface of the second blade 102B abuts against the plurality of protrusions 102P of the first blade 102A to form the "gap" between the first and second blades 102A, 102B.

The vacuum compartment 104, which is in fluid communication with the vacuum inlet 102, comprises a recess formed in the lower surface of the deck 82. This recess includes a compartment floor 104F and a contiguous compartment wall 104CW that delineates the perimeter of the vacuum compartment 104. An aperture 104A is formed through the floor 104, offset to one side of the floor 104F. Due to the location of this aperture 104A, offset from the geometric center of the compartment floor 104F, it is prudent to form several guide ribs 104GR that project upwardly from the compartment floor 104F. These guide ribs 104GR are operative to distribute air inflowing through the gap between the first and second blades 102A, 102B across the compartment floor 104 so that a constant air inflow is created and maintained over the entire gap, i.e., the vacuum inlet 102 has a substantially constant 'negative' pressure (with respect to atmospheric pressure).

The compartment cover 106 has a configuration that is complementary to the shape of the perimeter of the vacuum compartment 104. The cover 106 is further configured to be press fitted in sealed combination with the contiguous compartment wall 104CW wherein the vacuum compartment 104 and the vacuum cover 106 in combination define the vacuum chamber 108 of the vacuum assembly 100. The compartment cover 106 can be removed to clean any debris from the vacuum channel 112. The compartment cover 106 is preferable fabricated from a clear or smoky plastic material to allow the user to visually determine when clogging occurs.

The impeller 110 is mounted in combination with the deck 82 in such a manner that the inlet of the impeller 110 is positioned within the aperture 104A. The impeller 110 is operatively connected to the electric motor 46 so that torque is transferred from the motor 46 to the impeller 110 to cause rotation thereof at a constant speed to withdraw air from the vacuum chamber 108. The outlet of the impeller 110 is integrated in sealed combination with one end of the vacuum channel 112.

The vacuum channel 112 is a hollow structural member that is either formed as a separate structure and mounted to the deck 82 or formed as an integral part of the deck 82. The other end of the vacuum channel 110 is integrated in sealed combination with the vacuum inlet 86VI of the removable dust cartridge 86. The outer surface of the vacuum channel 112 is complementary in configuration to the external shape of curved arcuate member 86CAM of the removable dust cartridge 86.

A variety of modifications and variations of the present invention are possible in light of the above teachings. For example, the preferred embodiment described above included a cleaning head subsystem 80 that was self-adjusting, i.e., the deck 82 was automatically pivotable with respect to the chassis 21 during the adjustment mode in response to a predetermined increase in brush torque of the dual-stage brush assembly 90. It will be appreciated that another embodiment of the autonomous floor-cleaning robot according to the present invention is as described hereinabove, with the exception that the cleaning head subsystem is non-adjustable, i.e., the deck is non-pivotable with respect to the chassis. This embodiment would not include the deck adjusting subassembly described above, i.e., the deck would be rigidly secured to the chassis. Alternatively, the deck could be fabricated as an integral part of the chassis—in which case the deck would be a virtual configuration, i.e., a construct to simplify the identification of components comprising the cleaning head subsystem and their integration in combination with the robot.

It is therefore to be understood that, within the scope of the appended claims, the present invention may be practiced other than as specifically described herein.

What is claimed is:

1. A floor-cleaning robot comprising:

a wheeled housing having a perimeter;

a motor drive operably connected to wheels of the housing to move the robot across a floor surface;

a bumper responsive to obstacles encountered by the robot;

a controller in electrical communication with both the bumper and the motor drive and configured to control the motor drive to maneuver the robot to avoid detected obstacles across the floor surface during a floor-cleaning operation;

a driven cleaning brush, rotatable about an axis substantially parallel to an underside of the housing, the driven cleaning brush being disposed substantially across a central region of the underside and positioned to brush the floor surface as the robot is moved across the floor surface; and a driven side brush, comprising resilient brush arms extending outwardly from a hub and extending beyond the perimeter as the hub rotates and positioned to brush floor surface debris from beyond the perimeter toward a projected path of the driven cleaning brush along the floor surface, each of the brush arms having bristles at a distal end of each brush arm.

2. The floor cleaning robot of claim 1, further comprising a vacuum with a vacuum inlet positioned on the underside of the housing and rearward of the driven cleaning brush.

3. The floor cleaning robot of claim 2, further comprising a particulate receptacle positioned to receive and collect particulates ingested through the vacuum inlet.

4. The floor cleaning robot of claim 3, wherein the receptacle comprises a removable dust cartridge.

5. The floor cleaning robot of claim 2, wherein the vacuum inlet comprises an elongated slot extending substantially across the central region of the underside of the housing.

6. The floor cleaning robot of claim 5, further comprising a first resilient blade extending from the underside of the housing immediately rearward of the vacuum inlet slot and having a distal edge configured to wipe the floor surface.

7. The floor cleaning robot of claim 6, further comprising a second resilient blade extending from the underside of the housing immediately forward of the vacuum inlet slot.

8. The floor cleaning robot of claim 1, further comprising a particulate receptacle positioned to receive and collect particulates brushed from the floor surface by the driven cleaning brush.

9. The floor cleaning robot of claim 1, wherein the driven side brush is configured to rotate about an axis substantially perpendicular to the floor surface.

10. The floor cleaning robot of claim 1, further comprising a cliff detector which is configured to detect a falling edge of the floor surface when the robot is moving towards the falling edge.

11. The floor cleaning robot of claim 10, wherein the controller is configured to redirect the robot in response to detection of the floor surface falling edge.

12. The floor cleaning robot of claim 10, wherein the cliff detector is positioned adjacent to a forward edge of the housing.

13. The floor cleaning robot of claim 1, further comprising at least one friction pad on the underside of the housing and positioned to engage the floor surface and inhibit robot motion when a forward wheel of the robot travels beyond a falling edge of the floor surface.

14. The floor cleaning robot of claim 1, wherein the bumper comprises a displaceable bumper positioned along the housing perimeter, the robot further comprising a bumper displacement sensor responsive to displacement of the bumper with respect to the housing.

15. The floor cleaning robot of claim 14, wherein the bumper displacement sensor comprises an infrared break beam sensor.

16. The floor cleaning robot of claim 1, wherein the controller is configured to move the robot in a wall-following mode to maneuver the robot along a wall in a direction that places the driven side brush against the wall.

17. The floor cleaning robot of claim 1, wherein the housing perimeter is substantially round.

18. The floor cleaning robot of claim 1, wherein the driven cleaning brush comprises first and second brushes that counter rotate with respect to one another.

19. The floor cleaning robot of claim 18, wherein the first brush comprises a flapper brush.

20. The floor cleaning robot of claim 18, wherein the second brush comprises a bristle brush.

21. The floor cleaning robot of claim 1, wherein the driven cleaning brush is mounted on a deck pivotally coupled to a portion of the housing to which the wheels are mounted.

22. The floor cleaning robot of claim 1, wherein the motor drive comprises separate motors operably connected to respective wheels of the housing, the controller configured to independently drive the separate motors to turn the robot.

23. The floor cleaning robot of claim 1, wherein the wheels are positioned to enable the robot to spin in place.

24. A self-propelled floor-cleaning robot comprising a housing defining a substantially round housing perimeter;

a driven cleaning brush disposed within the round housing perimeter and positioned to engage a floor surface;

a driven side brush, comprising resilient brush arms extending outwardly from a hub and extending beyond the round housing perimeter as the hub rotates and positioned to brush floor surface debris from beyond the round housing perimeter along the floor surface, each of the brush arms having bristles at a distal end of each brush arm;

a bumper responsive to obstacles encountered by the robot; and a controller in electrical communication with a motor drive and configured to control the motor drive to maneuver the robot about detected obstacles located on the floor surface, during a floor-cleaning operation.

25. The floor cleaning robot of claim 24, further comprising a vacuum with a vacuum inlet positioned on the underside of the housing and rearward of the driven cleaning brush.

26. The floor cleaning robot of claim 25, further comprising a particulate receptacle positioned to receive and collect particulates ingested through the vacuum inlet.

27. The floor cleaning robot of claim 26, wherein the receptacle comprises a removable dust cartridge.

28. The floor cleaning robot of claim 25, wherein the vacuum inlet comprises an elongated slot extending across a central region of the underside of the housing.

29. The floor cleaning robot of claim 28, further comprising a first resilient blade extending from the underside of the housing immediately rearwardly of the vacuum inlet slot and having a distal edge configured to wipe the floor surface.

30. The floor cleaning robot of claim 29, further comprising a second resilient blade extending from the underside of the housing forward of the vacuum inlet slot.

31. The floor cleaning robot of claim 24, further comprising a particulate receptacle positioned to receive and collect particulates brushed from the floor surface by the driven cleaning brush.

32. The floor cleaning robot of claim 24, wherein the driven cleaning brush is rotatable about an axis substantially parallel to the floor surface and wherein the driven side brush rotatable about an axis substantially perpendicular to the floor surface.

33. The floor cleaning robot of claim 24, further comprising a cliff detector which is configured to detect a falling edge of the floor surface when the robot is moving towards the falling edge.

34. The floor cleaning robot of claim 24, further comprising at least one friction pad on the underside of the housing and which is positioned to engage the floor surface and inhibit robot motion when a forward wheel of the robot travels beyond a falling edge of the floor surface.

35. The floor cleaning robot of claim 24, wherein the bumper comprises a displaceable bumper positioned along the housing perimeter, the robot further comprising a bumper displacement sensor responsive to displacement of the bumper with respect to the housing.

36. The floor cleaning robot of claim 24, wherein the controller is configured to move the robot in a wall-following mode to maneuver the robot along a wall in a direction that places the driven side brush against the wall.

37. The floor cleaning robot of claim 24, wherein the driven cleaning brush is mounted on a deck pivotally coupled to a portion of the housing to which the wheels are mounted.

38. A floor-cleaning robot, comprising:

a housing including a chassis and having a periphery, a motor drive operable to generate movement of the robot across a surface during floor-cleaning, a vacuum having a vacuum inlet disposed at least in part within the chassis and operable to ingest particulates and thereby provide floor-cleaning, a cleaning brush operable to collect particulates from the surface during floor-cleaning;

a side brush, comprising resilient brush arms extending outwardly from a hub and extending beyond the periphery as the hub rotates and configured to direct particulates from outside of the periphery of the housing structure along the surface, toward the vacuum inlet during floor-cleaning, each of the brush arms having bristles at a distal end of each brush arm;

a removable dust cartridge which is removably connected to the housing and which is in communication with at least one of the vacuum or the cleaning brush, and which is operable to store particulates ingested by the vacuum or collected by the cleaning brush, a cliff detector operable to generate a cliff signal upon detection of a cliff during movement over the surface during floor cleaning, and a controller, in communication with the motor drive and responsive to a cliff signals generated by the cliff detector, wherein the controller is responsive to the cliff signal to control movement of the robot upon detection of a cliff to enable the robot to move away from the cliff and to continue movement.

39. The robot of claim 38, wherein the controller is responsive to the cliff signal to reduce velocity of movement of the robot upon detection of a cliff.

40. The robot of claim 38, wherein the controller is responsive to the cliff signal to change direction of movement of the robot upon detection of a cliff.

41. The robot of claim 38, further comprising:

an obstacle detection sensor operable to generate an obstacle signal upon detection of an obstacle, and wherein the controller is responsive to the obstacle signal to control movement of the robot upon detection of an obstacle.

42. The robot of claim 41, wherein:

the obstacle detection sensor comprises a tactile sensor, and the controller is responsive to the obstacle signal generated by the tactile sensor to cause the robot to execute an escape behavior and continue movement.

43. The robot of claim 38, wherein:

the controller is configured to operate the robot in, and to select from any of a plurality of modes, the plurality of modes comprising:

a spot-coverage mode whereby the robot provides coverage of a spot on the floor, an obstacle following mode whereby the robot travels adjacent to an obstacle, and a bounce mode whereby the robot travels substantially in a direction away from an obstacle after detecting an obstacle.

* * * * *